US005586840A

United States Patent [19]

Nishio et al.

[11] Patent Number: 5,586,840

[45] Date of Patent: Dec. 24, 1996

[54] APPARATUS FOR DIGGING SOIL FOUNDATION AND METHOD FOR CONSTRUCTING UNDERGROUND WALL BY USING THE APPARATUS

[75] Inventors: Tadashi Nishio; Shuichi Fukuda, both of Tokyo, Japan

[73] Assignee: Concrete Coring Company, Tokyo, Japan

[21] Appl. No.: 501,101

[22] PCT Filed: Nov. 30, 1994

[86] PCT No.: PCT/JP94/02006

§ 371 Date: Jul. 28, 1995

§ 102(e) Date: Jul. 28, 1995

[87] PCT Pub. No.: WO95/15419

PCT Pub. Date: Jun. 8, 1995

[30] Foreign Application Priority Data

Nov. 30, 1993 [JP] Japan ..... 5-229242
Dec. 28, 1993 [JP] Japan ..... 5-335181

[51] Int. Cl.[6] ..... E02D 3/12; E02D 5/18

[52] U.S. Cl. ..... 405/267; 405/232; 405/241; 405/269

[58] Field of Search ..... 405/267, 266, 405/232, 231, 240–243, 269, 233; 175/323, 394, 344

[56] References Cited

U.S. PATENT DOCUMENTS 4,057,969 11/1977 Rochmann ..... 405/267
4,902,172 2/1990 Fukuda ..... 405/269
4,906,142 3/1990 Taki et al. ..... 405/241 X
5,141,364 8/1992 Degen et al. ..... 405/233 X

FOREIGN PATENT DOCUMENTS 0132221 5/1990 Japan ..... 405/267
5025820 2/1993 Japan ..... 405/267

*Primary Examiner*—Dennis L. Taylor
*Attorney, Agent, or Firm*—McGlew and Tuttle

[57] ABSTRACT

The digging bits system contains left, right and central cylindrical digging bits and left and right plate digging bits being installed between the cylindrical digging bits, respectively. To the cylindrical digging bits, percussion force and turning force are applied. Each of the cylindrical digging bit contains tip, intermediate and upper end tubular body and is provided with a pore therein, respectively. To each of the tip tubular body, a bit edge is fixed, respectively. To both of the upper and the under end sides of the middle tubular body, a cam is provided in one unit with the tubular body, respectively. Each of the plate digging bits contains a sleeve, a central sleeve and a plurality of bit pieces, respectively. The cylindrical digging bits are rotatably connected with each other via a connecting member. In the apparatus, a percussion force transfer device A for transferring percussion force from the cylindrical digging bit to the plate digging bit respectively and a moving direction converter B for converting the turning force of the digging bit to the reciprocating moving via the connection of the cam and a follower to thereby transfer the force to the plate digging bit, respectively.

12 Claims, 23 Drawing Sheets

FIG. 8
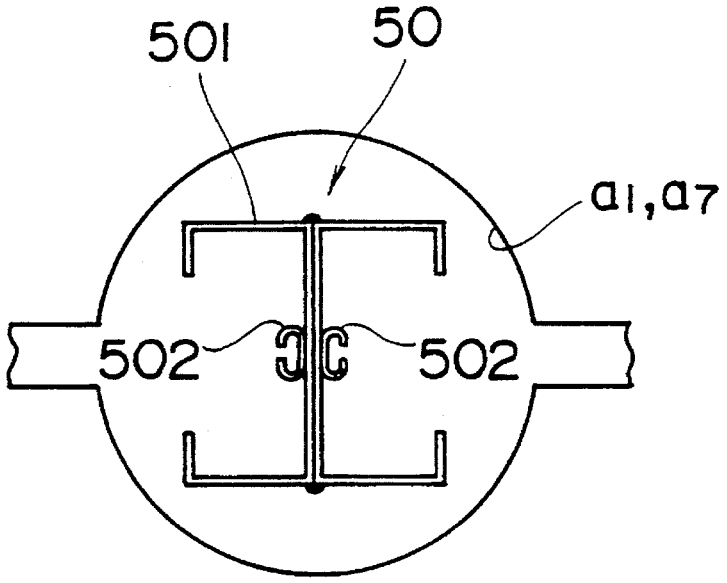
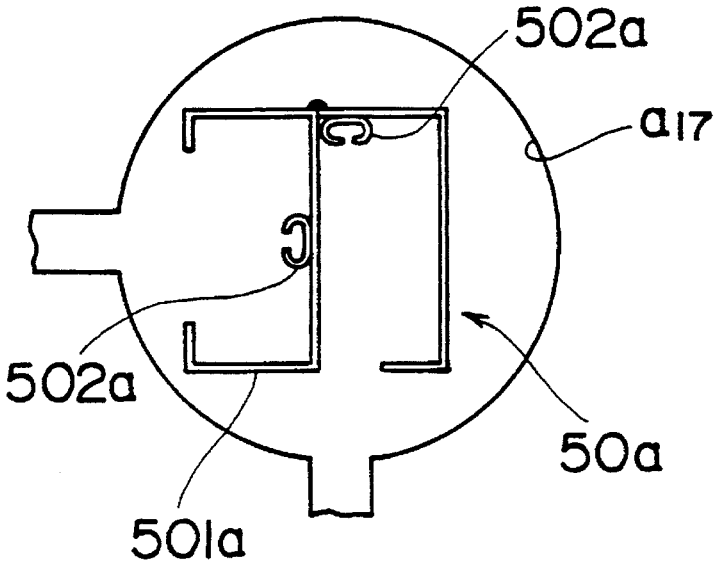
FIG. 9

FIG. 13
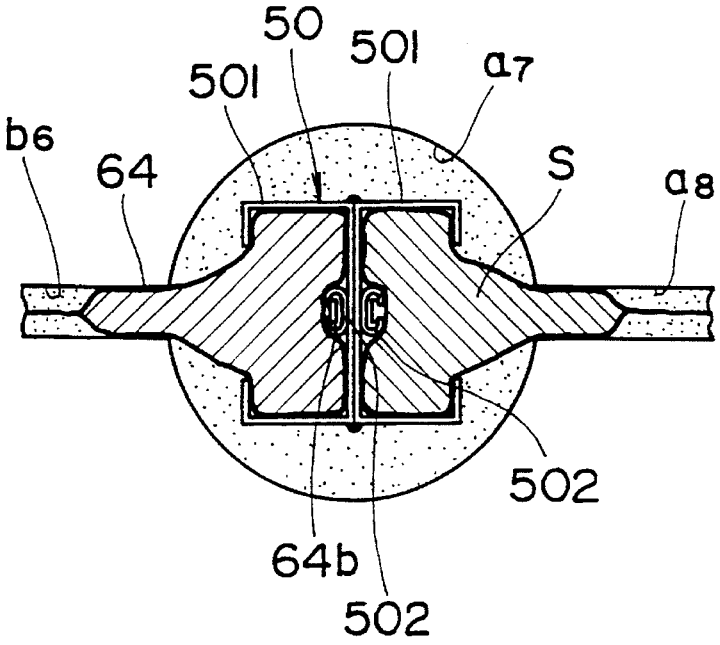
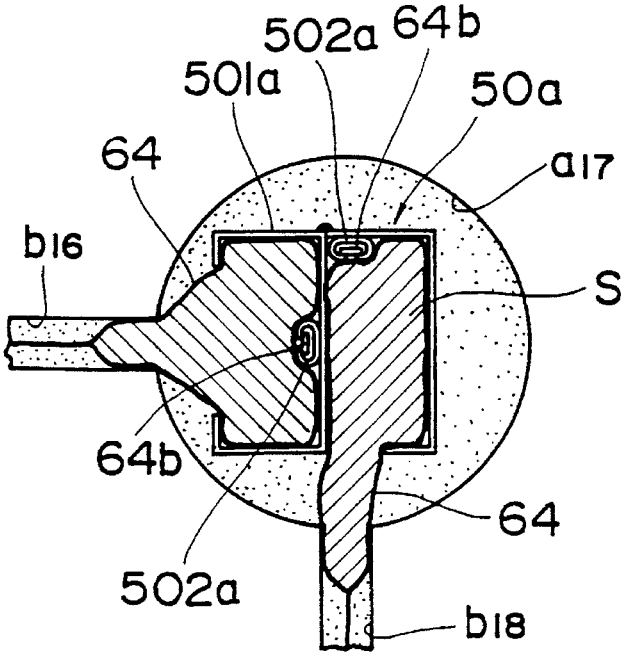
FIG. 14

APPARATUS FOR DIGGING SOIL FOUNDATION AND METHOD FOR CONSTRUCTING UNDERGROUND WALL BY USING THE APPARATUS

FIELD OF THE INVENTION

The present invention is directed to an apparatus for digging soil foundation and a method for constructing an underground wall by using the apparatus, and more particularly to an apparatus for digging a soil foundation which is capable of digging thin ditches in a soil foundation containing stone pieces and subsequently constructing underground wall in a form extending along the ditches. The present invention also includes a method for constructing the underground walls by using the apparatus.

BACKGROUND OF THE INVENTION

A continuous underground wall construction method is known for constructing walls for blocking soil during the construction of underground structures and for constructing walls for blocking water to be constructed around a dam or a waste disposal facility. In this type of construction method, a rectangular ditch extending from the surface of the soil foundation up to a certain depth is dug, and a hardening substance such as concrete is then filled into the ditch to thereby form an unit wall in panel shape.

By repeating such process in turn, a continuous underground wall can be constructed in the soil foundation by continuously forming the unit wall in a row in the horizontal direction. In this method, there is a necessity to dig the soil foundation for making the rectangular ditches in the soil foundation. As an apparatus for digging soil foundation to be used for this type of digging, for example, grab-type digging apparatuses or rotary cutter-equipped digging apparatuses have been normally employed.

However, the prior digging apparatuses of such types have a technical problem as described hereinbelow.

Except in the case that the underground wall to be constructed is used as a part of an objective structure, it is enough for the underground wall if it has a strength required for a wall as far as the underground wall is used as a temporary structure. However, it is hard for the grab-type digging apparatuses and the rotary cutter-equipped digging apparatuses of the past to make relatively thin ditches in soil foundation. Although the miniaturization of these apparatuses can facilitate to make such thin ditches to come extent, it was very difficult to make thin ditches in a soil foundation particularly a soil foundation which contains a lot of stone pieces, even by using such miniaturized-apparatus. Therefore the construction of a thin underground wall in soil foundations containing a great amount of stone pieces was almost impossible to carry out.

On the other hand, an apparatus for digging a soil foundation wherein a plurality of cylindrical digging bits are linearly arranged has been provided for the construction of columnar under ground walls in a row. With this type of apparatus for digging in soil foundation, it is possible to make relatively thin ditches in a soil foundation even it contains lot of stone pieces if the diameter of the digging bit is reduced and a device for impressing percussion force is used. However, when a plurality of cylindrical digging bits with a small diameter are arranged in a row in the apparatus, the structure of the apparatus become much too complex and then the possible number of digging bits to be arranged is limited. Thereby the length of the ditch made at one time of digging is limited to short lengths, which leads to a problem of the decrease in the efficiency for the digging.

SUMMARY AND OBJECTS OF THE INVENTION

The object of the present invention is to solve the problems as described above, and it is also an object of the present invention to provide an apparatus for digging soil foundation capable of efficiently making thin ditches. It is an another object of the present invention to provide a method for constructing underground walls, which is capable of efficiently constructing the underground walls having a structure in which thin plate walls are connected in between cylindrical poles having a large diameter.

For accomplishing the object as described above, the present invention is directed to an apparatus for digging soil foundation to be set on the surface of soil foundation at the site of digging, comprising cylindrical digging bits wherein a pore for supplying muddy water is provided along with a central shaft in each of the bit, a rotary driving device and a percussion impressing device both of which are installed on the upper end side of the cylindrical digging bit, respectively and plate digging bits being extended from the cylindrical digging bit toward the radial direction thereof, respectively and characterized in that a percussion force transfer device for transferring percussion force fed by the percussion impressing device to the plate digging bit and a moving direction converter for converting rotational force generated by the rotary driving device to the reciprocating moving and then transferring the force to the plate digging bit is installed in between the cylindrical digging bit and the plate digging bit, respectively and the plate digging bit is formed in a thickness less than the diameter of the cylindrical digging bit.

The cylindrical digging bits comprise a plurality of bits each of which shaft center positions on substantially the same plane, wherein connecting members for rotatably connecting each cylindrical digging bit are installed to between the cylindrical digging bits.

The apparatus of the present invention can be constituted such that the cylindrical digging bits are composed of at least three bits, the percussion force transfer member and the moving direction converter are installed to between the central cylindrical digging bit and the plate digging bit, and the plate digging bit is installed to between the adjacent cylindrical digging bits, respectively, where each of the plate digging bits take reciprocating moving in the same direction.

Alternatively, the apparatus can be also constituted such that the cylindrical digging bits are composed of at least three bits, a pair of the moving direction converters are installed to between the central cylindrical digging bit and the plate digging bit, respectively and the plate digging bit is installed to between the adjacent cylindrical digging bits, respectively, where each of the plate digging bits mutually take reciprocating moving in different directions.

Further thereto, the apparatus can be further constituted such that the moving cylindrical digging bits are composed of at least three bits, and the moving direction converters are installed to the cylindrical digging bits, respectively.

The moving direction converter can be composed of a cam provided to the outer peripheral surface of the cylindrical digging bit and a follower provided to the interior peripheral surface of the tube in the plate digging bit to which the cylindrical digging bit is fixed by insertion.

The plate digging bit can be composed of a plurality of bit pieces of which length is corresponding to the reciprocating moving stroke of the plate digging bit, and these bit pieces can be arranged in a manner that the convex part of the adjacent bit pieces intersect with each other.

As a method for constructing underground walls wherein the digging apparatus described above is used, there is a construction method of underground walls consisting of two processes, that is, the first process to make holes in soil foundation while filling bentonite-containing water into the soil foundation and the second process to fill a hardening muddy substance into the ditches then to harden it therein. This method is characterized in that a plurality of round holes are dug at fixed intervals in the soil foundation, then ditch-like space of which thickness is less than the diameter of the round holes are made between the round holes up to a fixed depth to connect the holes and the ditches, and the plate digging bits are subjected to reciprocating moving while receiving percussion force for making the ditch-like space, in the first process.

Prior to the second process, a plurality of joint members can be inserted into the round holes, and a bag-shaped sheet of which upper end is opened can be attached to between these joint members, then a sort of hardening muddy substance can be filled into the bag-shaped sheet to expand it, thereby blocking the connection between the round holes and the ditch-like space, and then the hardening muddy substance can be filled into the round holes and the ditches.

To the both lateral side and the bottom side of the sheet, bag parts in nearly concave shape to which the hardening muddy substance is filled can be formed, respectively.

According to the apparatus for digging soil foundation constituted as described above, the apparatus is set on the surface of soil foundation at the site of digging and comprises cylindrical digging bits in each of which are pore for supplying muddy water is provided along with the central shaft of the cylindrical digging bits, respectively, a rotary driving devices and a percussion impressing devices both of which are installed on the upper end side of the cylindrical digging bits, respectively, and plate digging bits each extending from the cylindrical digging bit toward the radial direction of the cylindrical digging bit, and wherein a percussion force transfer member for transferring percussion force fed by the percussion impressing device to the plate digging bit and a moving direction converter for converting tuning force generated by the rotary driving device to reciprocating moving and then transferring the force to the plate digging bit are installed in between the cylindrical digging bit and the plate digging bit, respectively, and the plate digging bits are formed in a thickness less than the diameter of the cylindrical digging bit, thereby allowing not only the cylindrical digging bits to make a plurality of the round holes but also the plate digging bits to make ditches of which thickness is less than the diameter of the round hole in between the round holes due to the reciprocating moving of the plate digging bits.

At the formation of the ditches, the percussion force fed by the percussion impressing device is applied to both the cylindrical digging bits and the plate digging bits, thereby allowing those digging bits to shred stone pieces even in soil foundation wherein lot of stone pieces are contained, owing to the percussion force.

Furthermore, by filling the hardening muddy substance such as concrete into the round holes and the ditches made by the digging apparatus described above and then hardening it therein, it becomes possible to efficiently construct the underground wall which connects the thin walls between the round poles.

BRIEF DESCRIPTION OF THE DRAWINGS

FIG. 8 is described as being a sectional view for showing the section cut from VIII to VIII in FIG. 7;

FIG. 9 is described as being a sectional view for showing the section cut from IX to IX in FIG. 7;

FIG. 13 is described as being a sectional view for showing the section cut from XIII to XIII in FIG. 11;

FIG. 14 is described as being a sectional view for showing the section cut from XIV to XIV in FIG. 11;

DETAILED DESCRIPTION OF THE PREFERRED EMBODIMENTS

Figure 1:
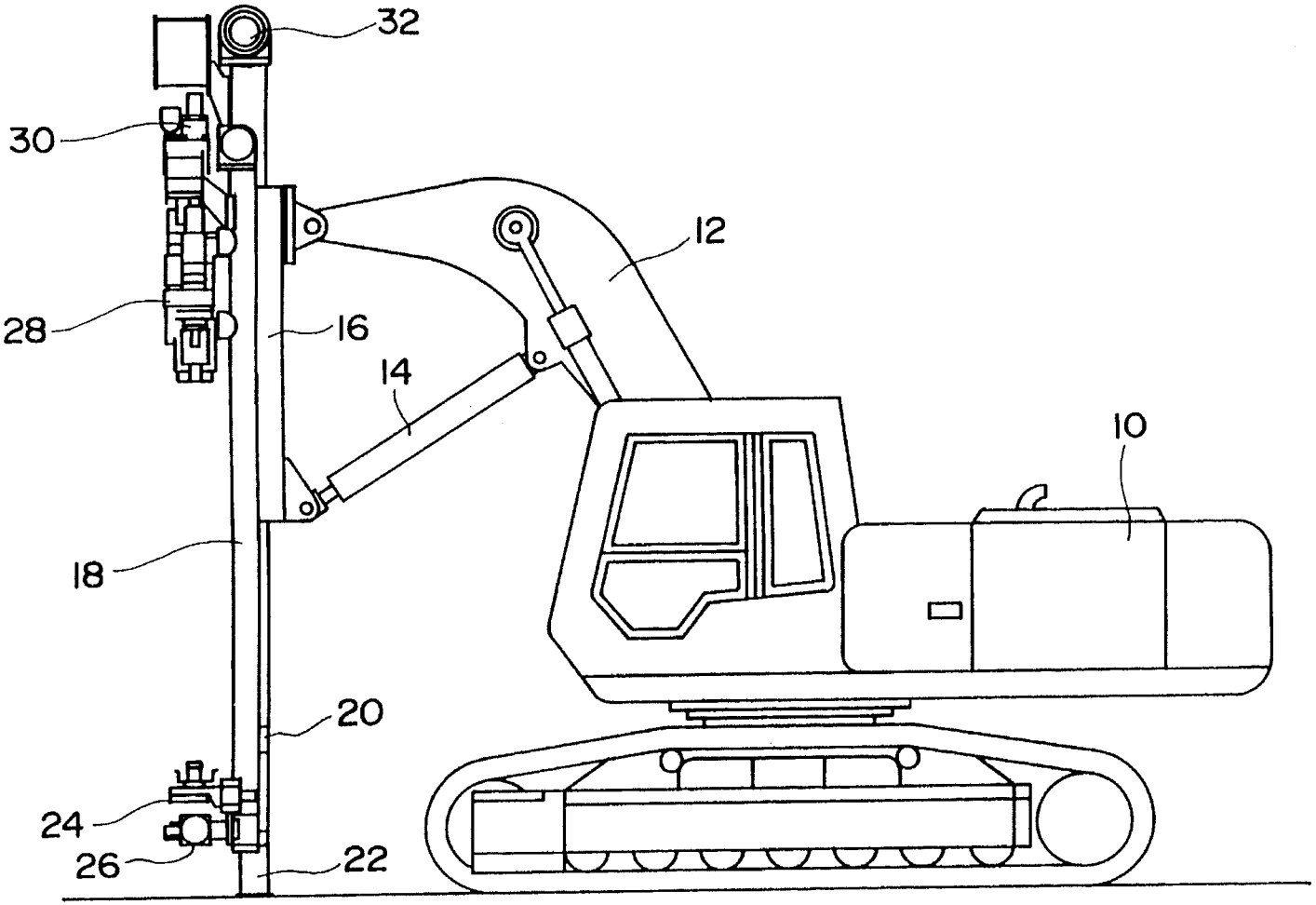
FIG. 1 is described as being a side view of a working vehicle to which the digging bits system in the first embodiment for the apparatus for digging soil foundation according to the present invention is installed.
Figure 2:
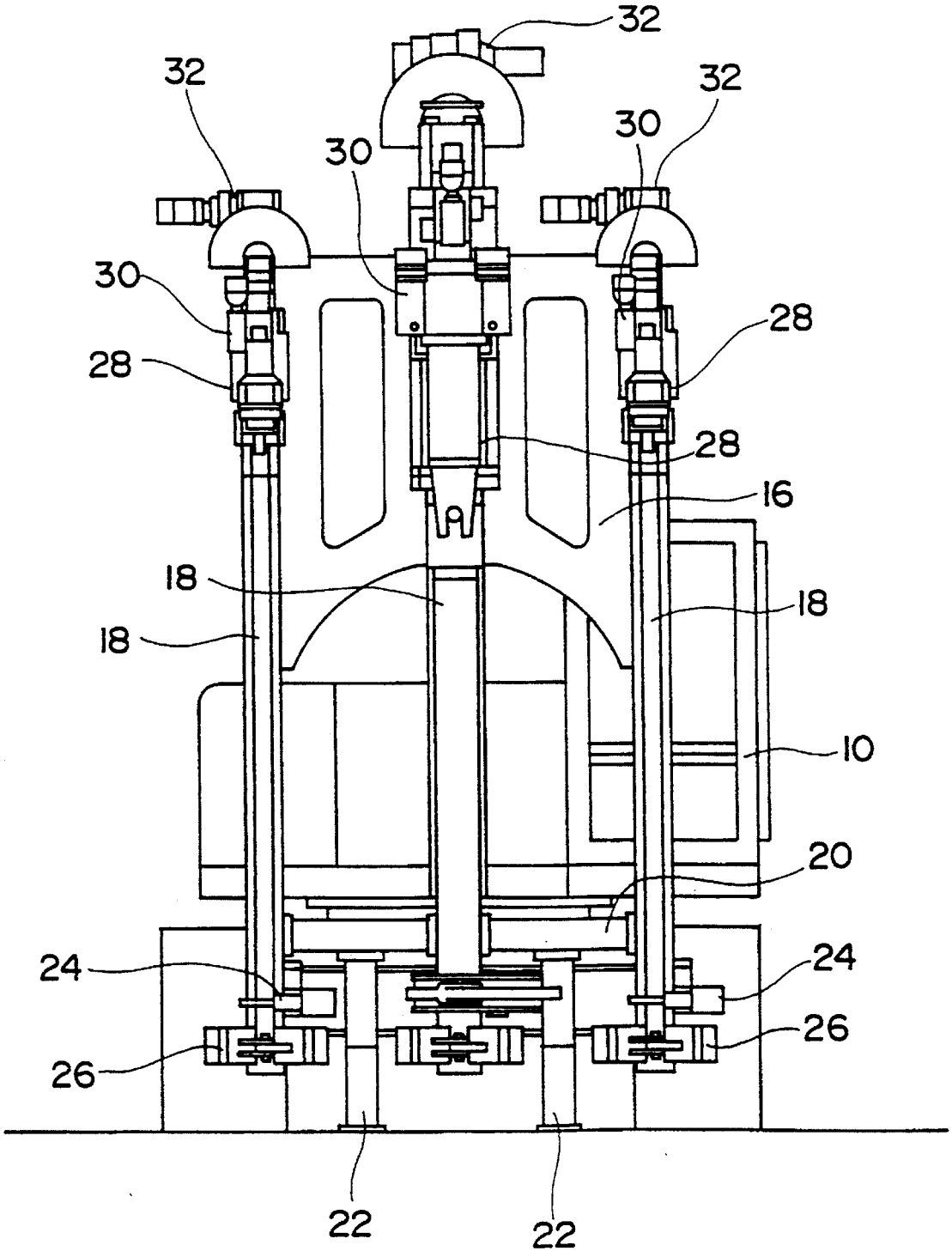
FIG. 2 is described as being a front view of the working vehicle as shown in FIG. 1.

The preferred embodiments for the apparatus for digging soil foundation according to the present invention are described in detail hereinbelow with referring the drawings attached hereto. FIGS. from 1 through 5 illustrate the first embodiment for the apparatus for digging soil foundation according to the present invention. The apparatus for digging soil foundation shown in the FIGS. from 1 through 5 is mounted on a caterpillar working vehicle 10. A swing arm 12 driven by a cylinder, and a vertically-movable cylinder 14 are mounted to the working vehicle 10. A holding plate 16 is mounted between the swing arm 12 and the vertically-movable cylinder 14 to fix them.

To the front side of the holding plate 16, three struts 18 are vertically fixed at fixed intervals. To the under end of the struts 18, connecting members 20 for connecting the two adjacent struts 18 are mounted between the struts 18, respectively, and to each of the connecting members 20, an outrigger 22 for adjusting the fixing position of the apparatus on the surface of soil foundation is mounted, respectively. Near the under end of each of the strut 18, a rod breaker 24 and a rod holder 26 are equipped, respectively.

To the upper end of each of the struts 18, a percussion head (percussion impressing device) 28 and a rotary driving device 30 are equipped, respectively. Further, to the upper end of each of the strut 18, a power feeder 32 for pulling out the apparatus for digging soil foundation is mounted, respectively. The percussion head 28 contains a hydraulic piston therein in order to gain the percussion force by travelling the piston vertically.

Figure 3:
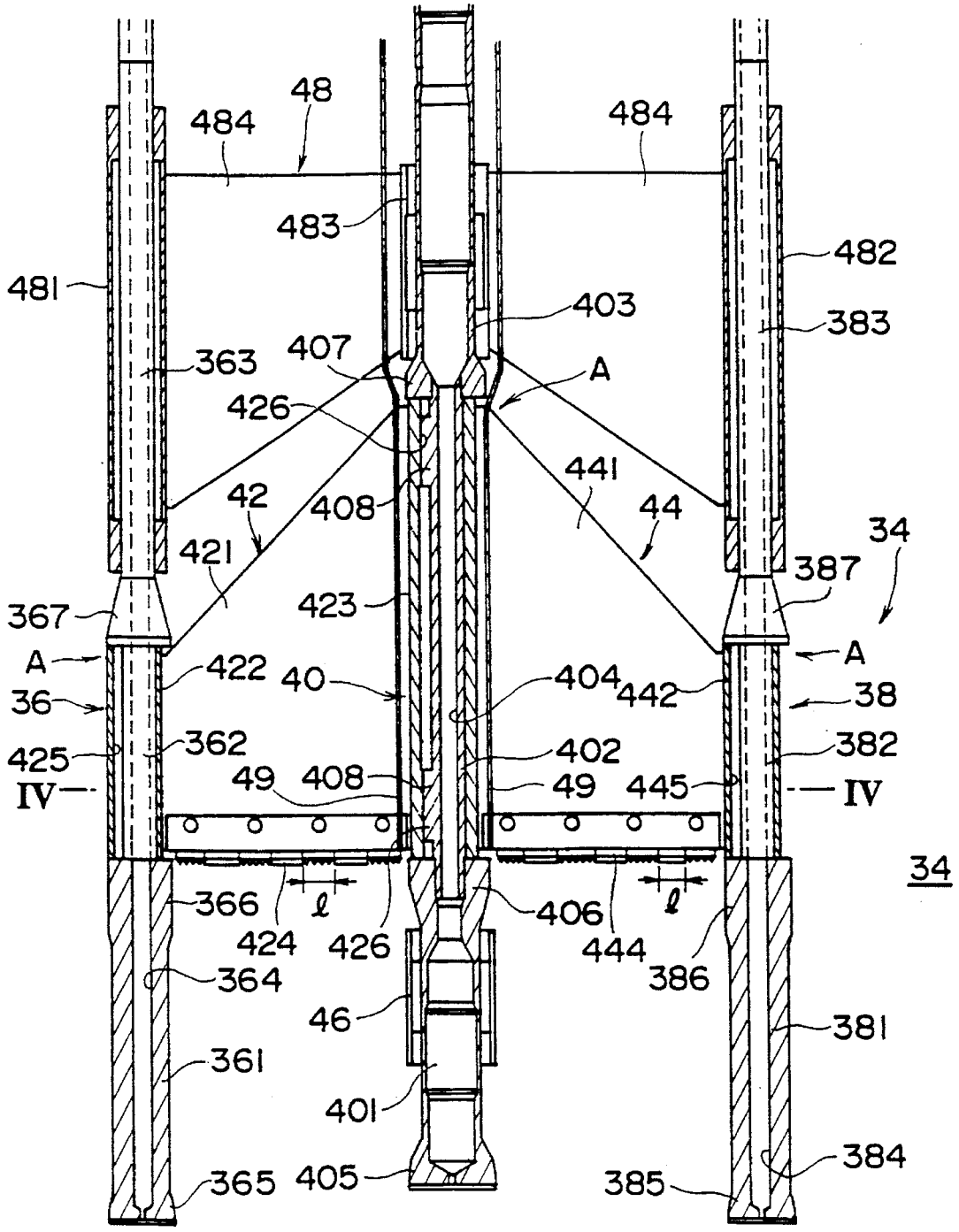
FIG. 3 is described as being a front view of the digging bits system for illustrating the first embodiment for the apparatus for digging soil foundation according to the present invention.
Figure 4:
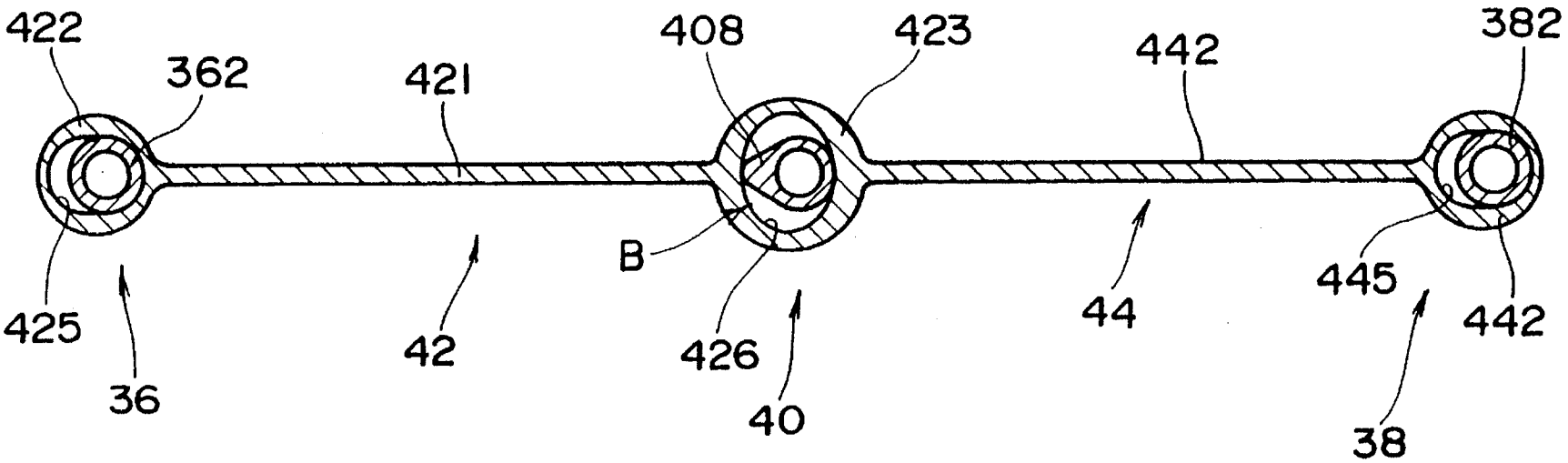
FIG. 4 is described as being a sectional view for showing the section cut from IV to IV in FIG. 3.

For the rotary driving device 30, for example, a hydraulic motor can be utilized. The digging bits system 34, which s a major member of the apparatus for digging soil foundation according to the first embodiment, is mounted to the under end of the percussion heads 28, and the details of the system are illustrated in FIGS. 3 and 4. The digging bits system 34 shown in the FIGS. 3 and 4 is substantially composed of cylindrical bits consisting of a left digging bit 36, a right digging bit 38 and a central digging bit 40. Left and right plate digging bits 42, 44 in a pair are mounted in between the cylindrical digging bits 36, 38, 40, respectively and are connected to the adjacent cylindrical digging bits, respectively. The left, right and central cylindrical digging bits 36, 38, 40 are mounted to the front side of the struts 18. The upper end of each cylindrical digging bit is mounted to the under end of the percussion head 28, respectively and the under end of each cylindrical digging bit is supported by the rod holder 26, respectively. To the upper end of each cylindrical digging bit 36, 38, 40 percussion force fed by the percussion head (percussion impressing device) 26 is applied, as well as turning force generated by the rotary driving device 28, respectively. The distance between the cylindrical digging bits, namely 36 and 38, and 38 and 40 is set in the same distance as that of between the struts 18.

Each of the left, right and central cylindrical digging bit 36, 38, 40 has a tip tubular body 361, 381, 401, a middle tubular body 362, 382, 402 and an upper end tubular body 363, 383, 403, which are mounted thereto by screwing or fixing. Inside each of the cylindrical digging bits, a pore 364, 384, 404 is provided penetrating in the axial direction throughout the bit. Bentonite-containing water is supplied to these pores in order to secure the stability of the hole wall dug during the digging of soil foundation.

On the outer periphery around the tip of each of the tip tubular bodies 361, 381, 401, a bit edge 365, 385, 405 is fixed, respectively, while on the upper end side of each of the tip tubular bodies 361, 381, 401, a first expanding part 366, 386, 406 is formed with a diameter somewhat less than the diameter of the bit edge 365, 385, 405. In this embodiment, the whole length of both middle tubular bodies 362, 382 of the left and right cylindrical digging bits 36, 38 is shorter than the length of the middle tubular body 402 of the central cylindrical digging bit 40. On the under end of each of the upper end tubular bodies 363, 383, 403, a second expanding part 367, 387, 407, is formed respectively, which is in a truncated cone shape and has the same diameter as that of the first expanding part 366, 386, 406.

Furthermore, on both of the upper and under end sides of the middle tubular body 402 of the central cylindrical digging bit 40, a pair of cams in nearly elliptical shape extending out toward the same radius direction are formed in an unit with the tubular body, respectively.

Whereas, the left and right plate digging bits 42, 44 are composed of a base plate 421, 441 formed in approximately triangular shape, a pair of left and right hollow sleeves 422, 442 being fixed to both of the outer end of the base plate 421, 441, a hollow central sleeve 423 fixed to and extending over the internal ends of the both base plates 421, 441, and a plurality of bit pieces 424, 444 fixed to the under end of the base plates 421, 441, respectively.

The left and right sleeves 422, 442 are respectively mounted to the outer periphery of the middle tubular body 362, 382 of the left and right cylindrical digging bits 36, 38. The first expanding parts 366, 386 of the tip tubular bodies 361, 381 and the second expanding parts 367, 387 of the upper end tubular bodies 363, 383 are inserted into the upper and under end of the sleeves 422, 442, respectively. And each of the inserted-part constitutes a percussion force transfer part A for transferring percussion force fed by the percussion head 28 from the left and right cylindrical digging bit 36, 38 to the left and right plate digging bit 42, 44, respectively.

On the central shaft of each of the left and right sleeve 422, 442, a long pore 425, 445 of which longer axis takes position toward the plane direction of the base plate 421, 441 is formed in a state penetrating therethrough, respectively. The central sleeves 423 is mounted to the outer periphery of the middle tubular body 402 of the central cylindrical digging bit 40, and the first and second expanding part 406, 407 of the tip tubular body 401 and the upper end tubular bodies 403 are inserted into the upper and under ends of the central sleeve, respectively. And this inserted-part constitutes a percussion force transfer part A for transferring percussion force fed by the percussion head 28 from the central cylindrical digging bit 40 to the left and right plate digging bits 42, 44, respectively.

On the central shaft of the central sleeve 423, a follower surface 426 is formed in nearly an elliptical shape of which the longer axis side takes position toward the thickness or width direction of the bit piece 424, 444 whereas the short axis side thereof takes position toward the longitudinal direction of the bit piece 424, 444. The follower surface 426 is positioned in the central sleeve 423. As the sectional view of the follower 426 is shown in FIG. 4, the length of the follower 426 in the long axis direction is set to be somewhat longer than the length of a cam 408, while the length of the follower in the short axis direction is set to be nearly the same as the length of the cam 408. The follower 426 contacts the cam 408, forming a moving direction converting part or means B, for converting the turning force, which is generated by the rotary driving device 30 and applied to the central cylindrical digging bit 40, to a reciprocating moving, and then transferring the force to the left and right plate digging bit 42, 44, respectively.

It is not necessary to provide the follower 426 through the whole length of the central sleeve 423. For example, the follower 426 can be formed just within a range where it contacts the cam 408. In addition, in this embodiment, the thickness including the base plates 421, 441 of the left and right plate digging bits 42, 44 and the bit piece 424, 444 is set so as to be less than the diameter of the cylindrical digging bits 36, 38, 40.

Furthermore, a plurality of the bit pieces 424, 444 take position over the tip of the cylindrical digging bits 36, 38, 40. Each bit piece has substantially the same length as the reciprocating moving stroke 1 of the plate digging bits 42, 44, which is described later, and the bit pieces are arranged to each other such that the convex parts thereof mutually lie at right angles. In this case, however, such arrangement of the convex parts of the bit pieces 424, 444 at right angles is not always required. It is possible to arrange those convex parts in a state that they cross with each other at another fixed angle. A member indicated by a numeral 46 in FIG. 3 is a stabilizer mounted on the outer periphery of the tip tubular body 40*a* of the central cylindrical digging bit 40, which contacts to a wall of the hole dug with the bit edge 405 to thereby keep the stability of the central cylindrical digging bit 40 during the digging operation.

The member represented by a numeral 48 is a connecting member for rotatably connecting the left or right cylindrical digging bits 36, 38 and the central cylindrical digging bit 40 at their upper end sides, respectively and is composed of a left or right hollow tubular body 481, 482 to be fixed by insertion to the outer periphery of the upper end tubular body 363, 383 of the left or the right cylindrical digging bit 36, 38, a central tubular body 483 to be fixed by insertion to the outer periphery of the upper end tubular body 482 to be fixed by insertion to the outer periphery of the upper end tubular body 403 of the central cylindrical digging bit 40, and a pair of connecting plates 484 for connecting these tubular bodies 481 through 483, respectively.

In order to facilitate the connecting member 48 to go down into the dug-ditch as the digging operation is proceeding, the diameter of each of the tubular body 481 through 483 is set to be less than the diameter of the cylindrical digging bits 36, 38, 40, and the thickness of the connecting plate 484 is set to be less than the thickness of the bit pieces 422, 444. In addition, a member represented by a numeral 49 in FIG. 3 is a nozzle for injecting muddy water to each bit edge 424, 444 of the left 6 the right plate digging bit 42, 44 and subsequently pushing earth and sand dug out by the bit edges 424, 444 toward the side of the left and right cylindrical digging bits 36, 38.

Figure 6A:
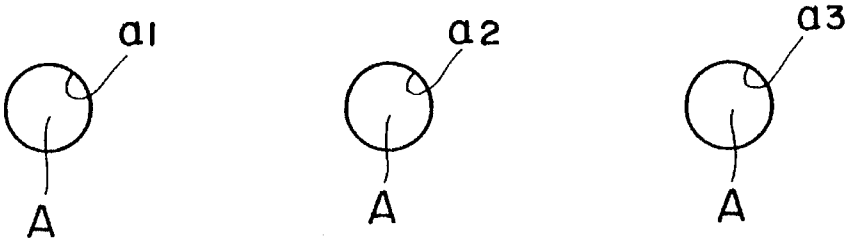
FIGS. 6A–C are described as being a plan view for explaining the first process to dig holes by the method for constructing underground walls according to the present invention.

Now, a process for constructing underground walls by using the apparatus for digging soil foundation composed as described above is explained. For constructing underground walls, the digging bits system 34 is firstly positioned in front of the struts 18, and each of the cylindrical digging bits 36, 38, 40 is stood substantially vertically on the surface of soil foundation at the site of digging. The percussion head 28 and the rotary driving device 30 are started. After the starting of the percussion head 28 and the rotary driving device 30, both the percussion force and the turning force are applied simultaneously to the cylindrical digging bits 36, 38, 40 via the upper ends thereof, thereby the soil foundation is dug with the bit edges 365, 385, 405. Then round holes $a_1$ through $a_3$ each of which is shaped corresponding to the shape of each bit 36, 38, 40, respectively, is formed as shown in FIG. 6(A).

When the digging operation for making the round holes $a_1$ through $a_3$ has proceeded and the left and right plate digging bits 42, 44 have reached to the surface of soil foundation, the percussion force fed by the percussion head 28 is transferred to the left and right plate digging bits 42, 44 via the percussion force transfer part A and the converted reciprocating moving force is transferred as well to the left and right plate digging bits 42, 44 via the moving direction converting part B, so that the left and right plate digging bits 42, 44 apply the percussion force to soil foundation while taking the reciprocating moving.

Figure 5A:
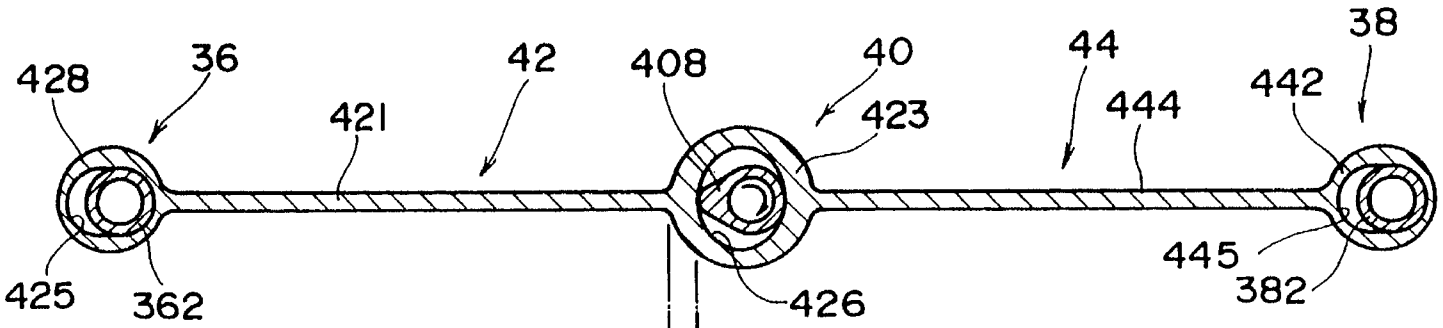
FIGS. 5A–B is described as being an illustrative diagram for explaining the reciprocating moving taken by the plate digging bits as shown in FIG. 3.

FIG. 5 shows the actuation of the moving direction converting part B for converting the turning force to be applied to the central cylindrical digging bit 40 via the rotary driving device 30 to the reciprocating moving in detail. Now, for example, in the initial state of the moving direction converting part B as shown in FIG. 5(A), the cam 408 is contacting to the follower 426 at a point corresponding to the short axial direction of the follower 426. When the central cylindrical digging bit 40 turns clockwise, the cam 408 turns by approximately 90 degree from the position as shown in (A) and to a position corresponding to the long axial direction of the follower 426. However, the sleeve 40*b* hardly moves toward the thickness direction of the plate of digging bits 42, 44 at this position of the cam 408 since the length of the long axis of the follower 426 is a little longer than the whole length of the cam 408.

Further, when the central cylindrical digging bit 40 turns further clockwise and the cam 408 turns by approximately 180 degree from the initial site to take a position corresponding to the short axial direction of the follower 426 as shown in FIG. 5(A) and (B), the cam 408 moves the follower 426 toward the right direction in this process, and this moving subsequently moves the central sleeve 423 in the same direction, consequently allowing the left and right plate digging bits 42, 44 to move in the same direction and in an equivalent amount because the central sleeve 423 is connected to both left and right sleeves 422, 442 via the base plates 421, 441, respectively.

Figure 5B:
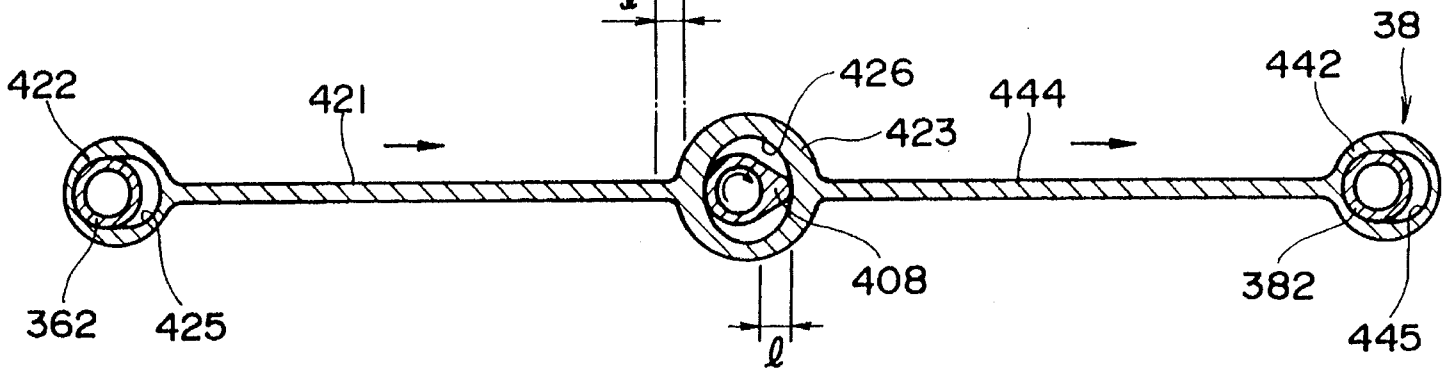

Subsequently, the central cylindrical digging bit 40 further turns clockwise and the cam 408 turns by approximately 180 degree so as to take a position corresponding to the short axial direction of the follower 426 as shown in FIG. 5(B) and (A). Then the cam 408 moves the follower 426 toward the left direction by this turn, thereby the left and right plate digging bits 42, 44 move toward the left direction in an equivalent amount. Afterwards, the plate digging bits 42, 44 perform one reciprocating movement whenever the central cylindrical digging bit 40 turns around. The moving stroke I of that reciprocating moving corresponds to the peripheral length of the extruding part of the cam 408.

Figure 6B:
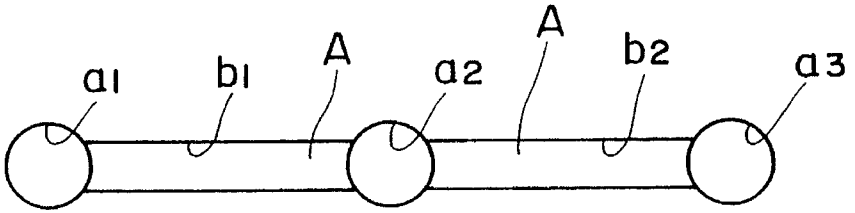

At this time, in the rotation process of the cam 408, the left and right cylindrical digging bits 36, 38, 40 can rotate owing to the connecting members 48 but the moving toward the other direction is regulated, so that the left and right plate digging bits 42, 44 are allowed to move just toward a straight direction passing through the center of each digging bit 36, 38, 40 and hardly move toward the thickness direction of the bit pieces 424, 444. By operating such reciprocating moving, the soil foundation within a range from the round hole a to the round hole as can be dug by the bit edges 424, 444 of the left and right plate digging bits 42, 44 and the percussion force is also applied to the digging bit at the same time. Thereby a thin ditch-like space $b_1$ $b_2$ can be made even in soil foundation such as the one which contain great amount of stone pieces (see FIG. 6(B)).

In particular, in the digging apparatus composed as described above, the length of each bit piece 424, 444 is set to be approximately the same as the reciprocating moving stroke I and each bit piece 424, 444 is arranged in a manner that the convex part thereof lies at right angle with each other, which arrangement allow to carry out the digging of soil foundation more efficiently.

And, when the digging has proceeded further and the upper ends of the cylindrical-digging bits 36, 38, 40 are coming to close to the surface of soil foundation at the site of digging, the digging operation is halted for a time by cutting the connection between the percussion head 28 and the digging bits 36, 38, 40 by the rod breakers 24. The digging bits 36, 38, 40 are supported just by the rod holders 26. Then a supplemental rod is connected to each of the upper end thereof to repeat the same operation as described above for continuing the digging. By repeating such operation appropriately, the formation of ditch-like space to a desired depth can be achieved.

Figure 6C:
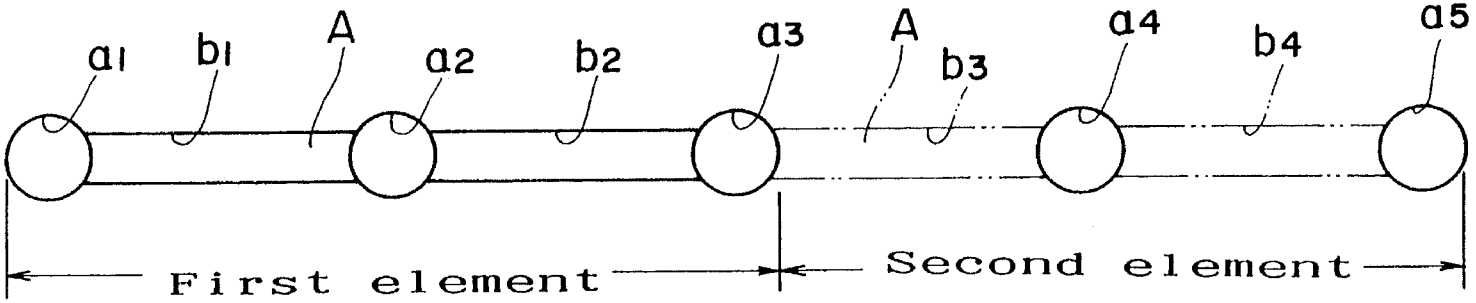

After making the round holes at through as and the ditch-like space $b_1$ $b_2$ up to a fixed depth according to the process as described above, the cylindrical digging bits 36, 38, 40 are then pulled out by actuating the power feeder 32 while detaching the supplemental rods connected to the cylindrical digging bits 36, 38, 40. Then digging is further carried out again according to the same procedure as described above by utilizing the round hole $a_3$, located at the end, as a guide to make round holes $_4$, $a_5$ being the second element and the ditch-like space $b_3$ $b_4$ (see FIG. 6(*c*)). Then both types of dug-holes and ditches $a_n$, $b_n$ are made as the third, 4th, . . . , n-th element by repeating the diggings according to the same procedure as described above. In the present invention, this step is the first process to make the dug-holes and ditches $a_n$, $b_n$ in the soil foundation.

In the first process to be operated as described above, the ditch-like space $b_1$ $b_2$ of which thickness is less than the diameter of the round holes $a_1$ through $a_3$ are made each between a plurality of the round holes $a_1$ through $a_3$. The percussion force is also applied at the time of digging the round holes $a_1$ through $a_3$ and the ditch-like space $b_1$, $b_2$. Owing to that force, the shredding of stone pieces contaminating in the soil foundation can be facilitated.

Moreover, according to the first process of this embodiment, after the prior formation of the round holes $a_1$ through $_3$, the ditch-like space $b_1$, $b_2$ each of which end respectively connects to the round hole $a_1$ through $a_3$ and of which thickness is less than the diameter of the round holes $a_1$ through $a_3$ can be made in between the round holes $a_1$ through $a_3$ owing to the reciprocating moving of the plate digging bits 42, 44, thereby the efficiency for making the dug-holes and ditches $a_n$, $b_n$ can be improved.

Figure 7:
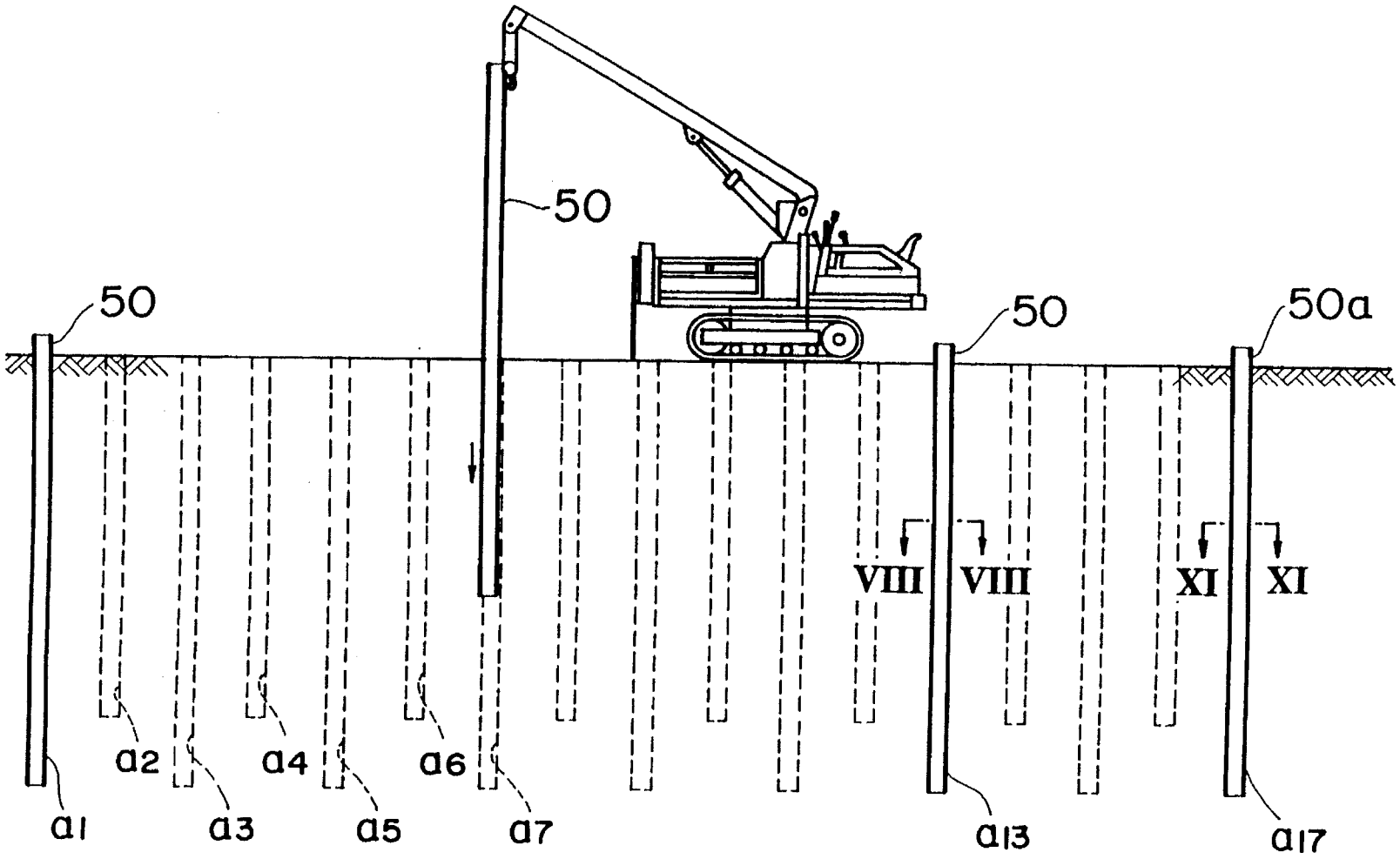
FIG. 7 is an illustrative diagram for explaining a process to insert joint members into the round holes made in the process shown in FIG. 6.

After the formation of the dug-holes and ditches $a_n$, $b_n$ according to the process as described above, the joint members 50, see FIG. 7, are respectively inserted at the stage that the holes were made. For example, elements 50 are inserted into a pair of the round holes $a_1$, $a_7$ which are positioning on the end side of the first and third elements, respectively, as shown in FIG. 7. Since underground walls for blocking soil are constructed in approximately rectangular shape, the joint members 50 to be used in this embodiment, that is a joint member 50 to be inserted into the round holes $a_1$, $a_7$, $a_{13}$ positioned at one side of the rectangle and a joint member $\mathbf{50}_a$ to be inserted into the round hole $a_{17}$ taking a position at the corner of the rectangle, are formed in different shapes.

As can be seen from the sectional view in FIG. 8, the joint member 50 to be inserted into the round holes $a_1$, $a_7$, $a_{13}$ is composed of a main part 501 wherein a pair of angular C-shaped structural steels are combined back to back and a pair of guide members 502 of which sectional view is nearly C-shaped. The guide members 502 being fixed to the interior central part of each of the angular C-shaped structural steels of the main part 501, respectively. The joint member 50*a* to be inserted into the round hole $a_{17}$ is composed of a main part 501*a* including an angular C-shaped structural steel and an roughly L-shaped structural steel, and a pair of guide members 502*a* of which sectional view is nearly C-shaped.

Figure 10:
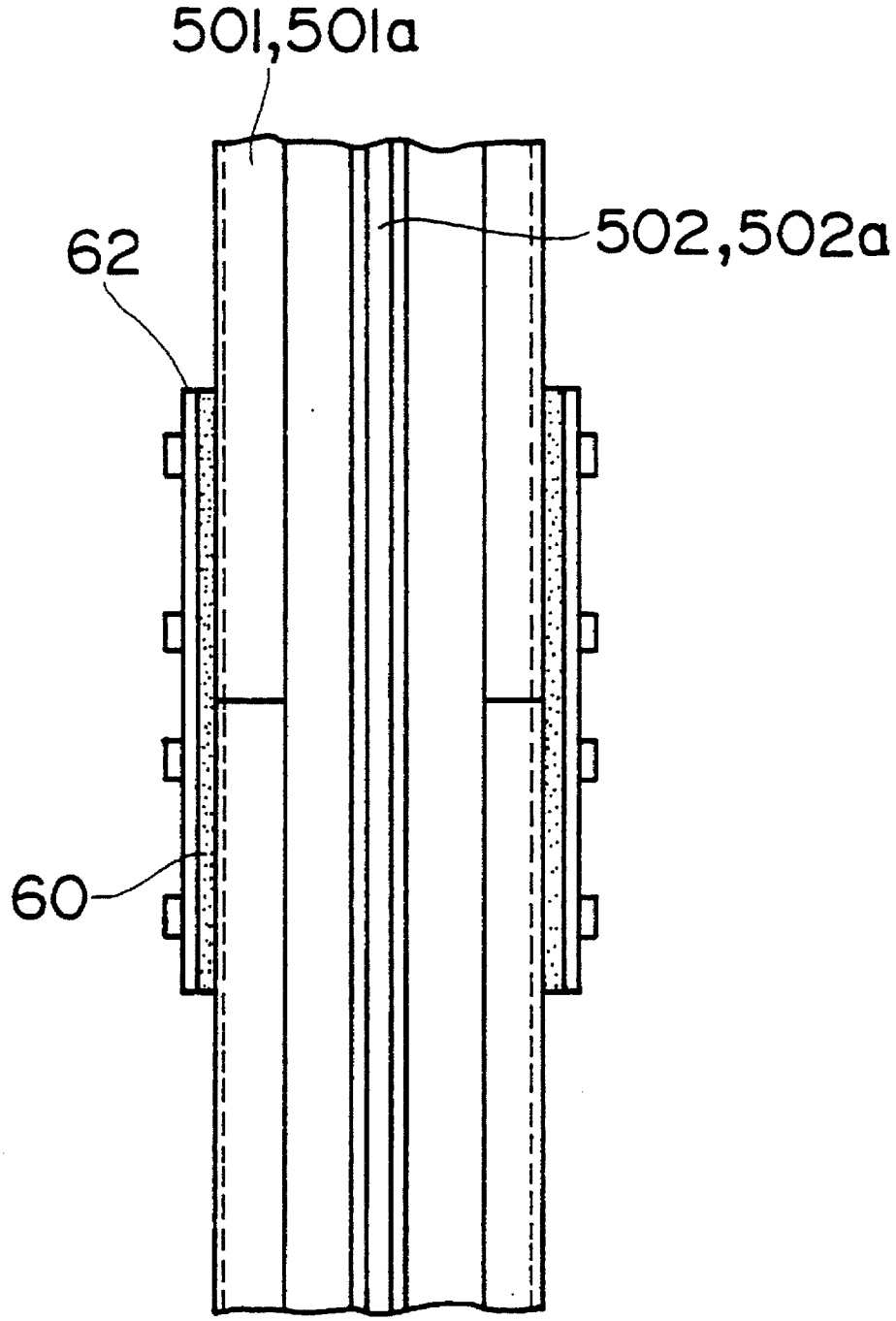
FIG. 10 is described as being a side view of the joint member as shown in FIG. 7.

The main part 501*a* is formed in a shape such that an end part of the L-shaped structural steel is fixed to one of the corner of the angular C-shaped structural steel, and one of the guide members 502*a* is fixed to the interior central part of the angular C-shaped structural steel, while the other guide member 502*a* is fixed to the connecting area between both of the structural steels. Each of the joint member 50, 50*a* has the same length as that of the round holes $a_1$ through $a_n$, and an additional holding plate 62 is fixed to the connecting area of the main part 501, 501*a* together with an intermediate lubber packing 60, as shown in FIG. 10.

After completing the insertion of the joint members 50, 50*a* to a fixed position, the installation of the sheet 64 to the joint members 50, 50*a* is carried out. For the sheet 64, a non-woven fabric or a woven fabric having a water permeability that does not pass the particles of hardening muddy substance such as cement paste, or a non-water permeable plastic sheet can be used. The sheet 64 has a width corresponding to the distance between the joint members 50, 50*a* being inserted in between the adjacent round holes and a length approximately equivalent to the length of the round holes $a_1$ through $a_n$.

Figure 11:
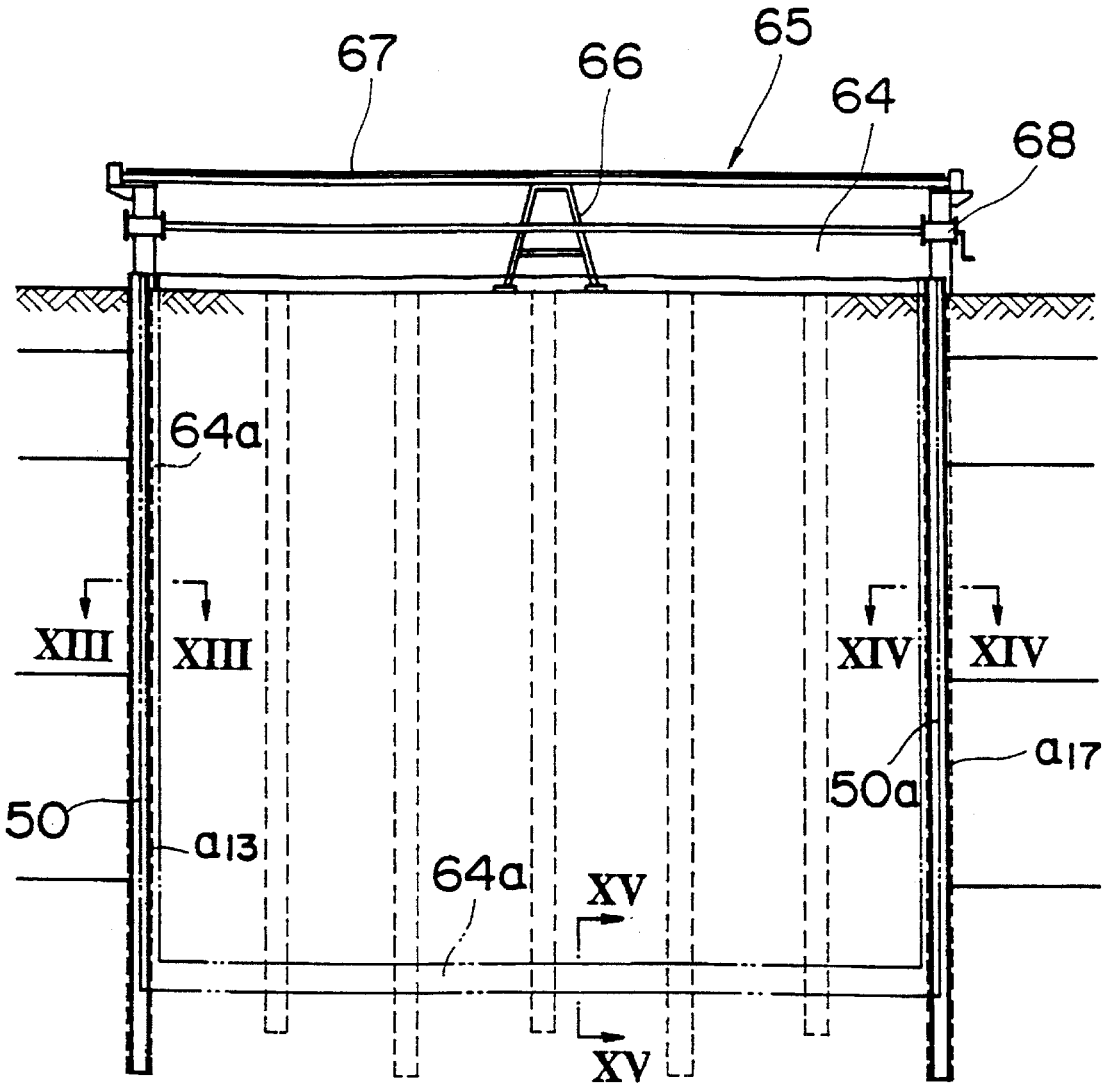
FIG. 11 is an illustrative diagram for explaining a manner to attach the pieces of sheet to between the joint members as shown in FIG. 7.
Figure 12:
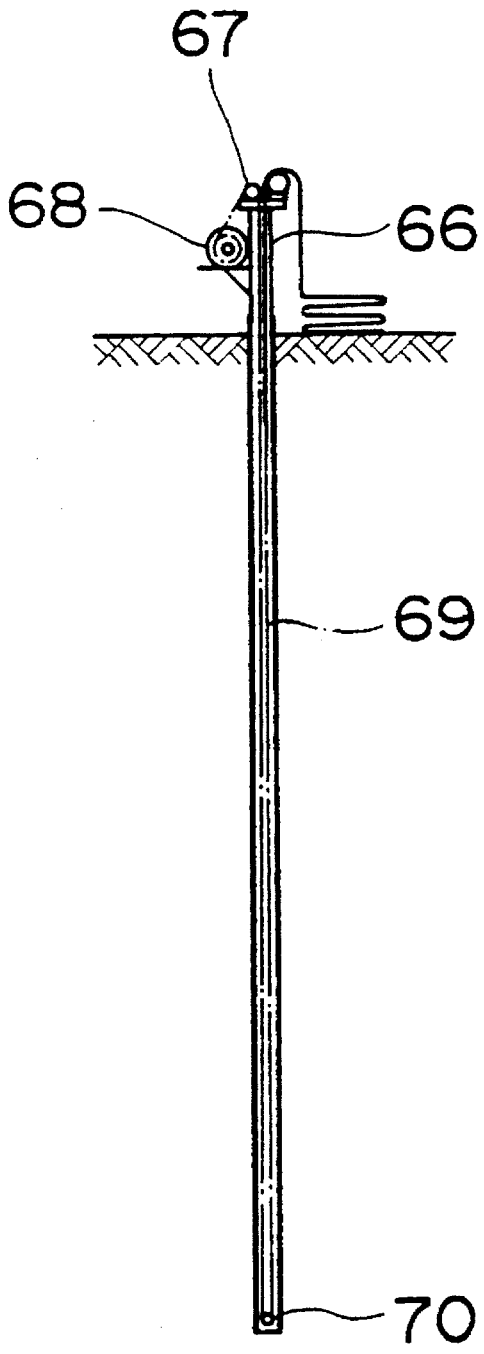
FIG. 12 is described as being a side view for explaining the manner specified in FIG. 11.

To both of the horizontal end sides and the bottom side of the sheet 64, a bag part $\mathbf{64}_a$ of which upper end is opened and being formed in shape having concave periphery is provided. For the fixing of the sheet 64, an fixing device 65 as shown in FIGS. 11 and 12 is used. The fixing device 65 shown in these figures contains a central trestle 66 to be arranged in the center between the joint members 50, a roller 67 for winding the sheet 64 and being rotatably supported on the central trestle 66, and a manual winch 68.

The manual winch 68 is for pulling out the sheet of 64 by winding a wire 69 of which one end is fixed to the bottom side of the sheet 64, and the wire 69 is wound beforehand into a pulley 70 provided on the tip of each joint member 50, 50*a*, which is inserted together with the joint member 50, 50*a* into the round holes $a_1$ through $a_n$.

To the outer lateral side of the bag parts 64*a* locating at both sides of the sheet 64, a guide piece 64*b* made with a smooth plate such as plastic is fixed, respectively, and the guide piece 64*b* is set by insertion into the guide member 502, 502*a* having the C-shaped section in the joint member 50, 50*a*. When the sheet 64 is positioned at a fixed place by operating the manual winch 68, a hardening muddy substance, for example cement paste S, is injected into the bag pan 64*a* of the sheet 64.

It is to be noted that the hardening muddy substance to be injected into the bag part 64*a* of the sheet 64 is not limited to the cement paste, and other substances such as hardening muddy water capable to replace bentonite-containing water being filled up in the dug-holes and ditches $a_n$, $b_n$ can be used as well. However, it is preferable to choose a substance which has a stronger tensile strength or uniaxial compressive strength and has a less coefficient of water permeability than that of the hardening muddy substance to be filled into the dug-holes and ditches $a_n$, $b_n$ when it is hardened.

Figure 15:
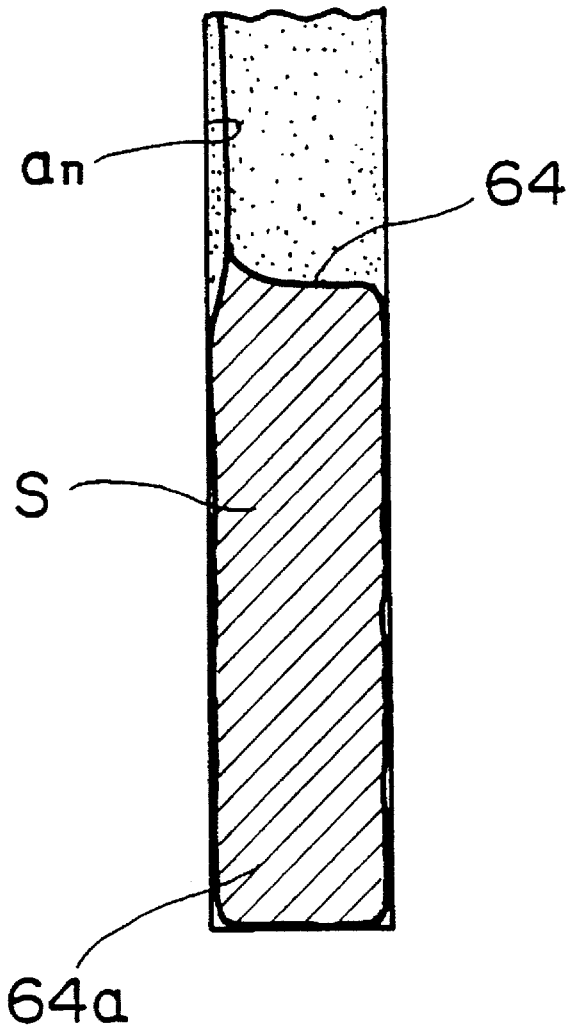
FIG. 15 is described as being a sectional view for showing the section cut from XV to XV in FIG. 11.

When the cement paste S is injected into the bag part 64*a* of the sheet 64, the bag part 64*a* expands as shown in FIGS. 13 through 15, and particularly near the joint member 50, 50*a*, it expands along with the interior peripheral surface of the main part 501, 501*a* of each of the joint member 50, 50*a*. Thereby the connection between the ditch-like space $b_n$ and the round hole $a_n$ is blocked. Therefore, by the solidification of the cement paste S, a great extent of water-blocking capacity can be obtained particularly at the connecting area of underground walls.

Figure 16:
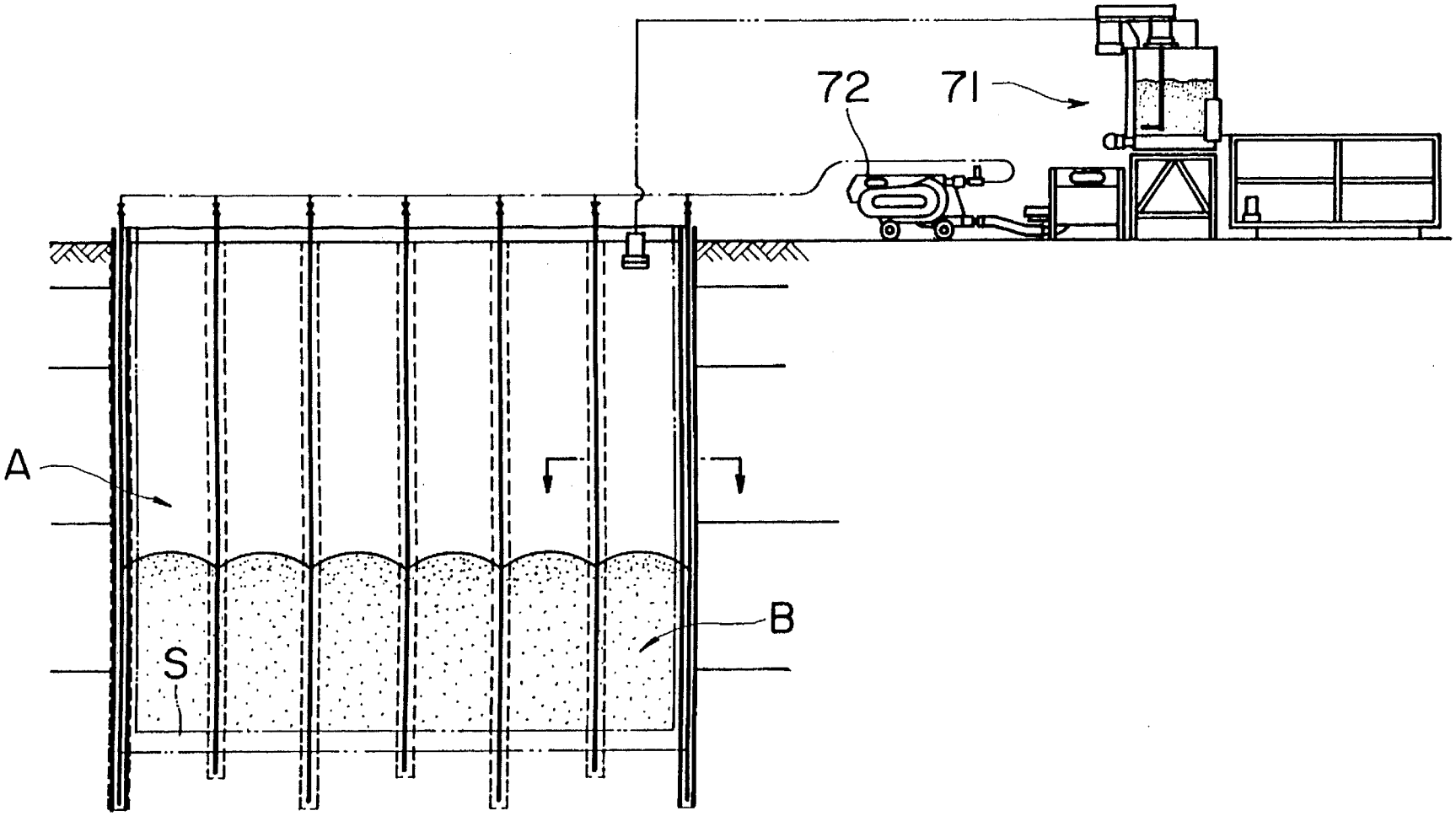
FIG. 16 is an illustrative diagram for explaining the second process to fill the hardening muddy substance into the round holes and the ditches.
Figure 17:
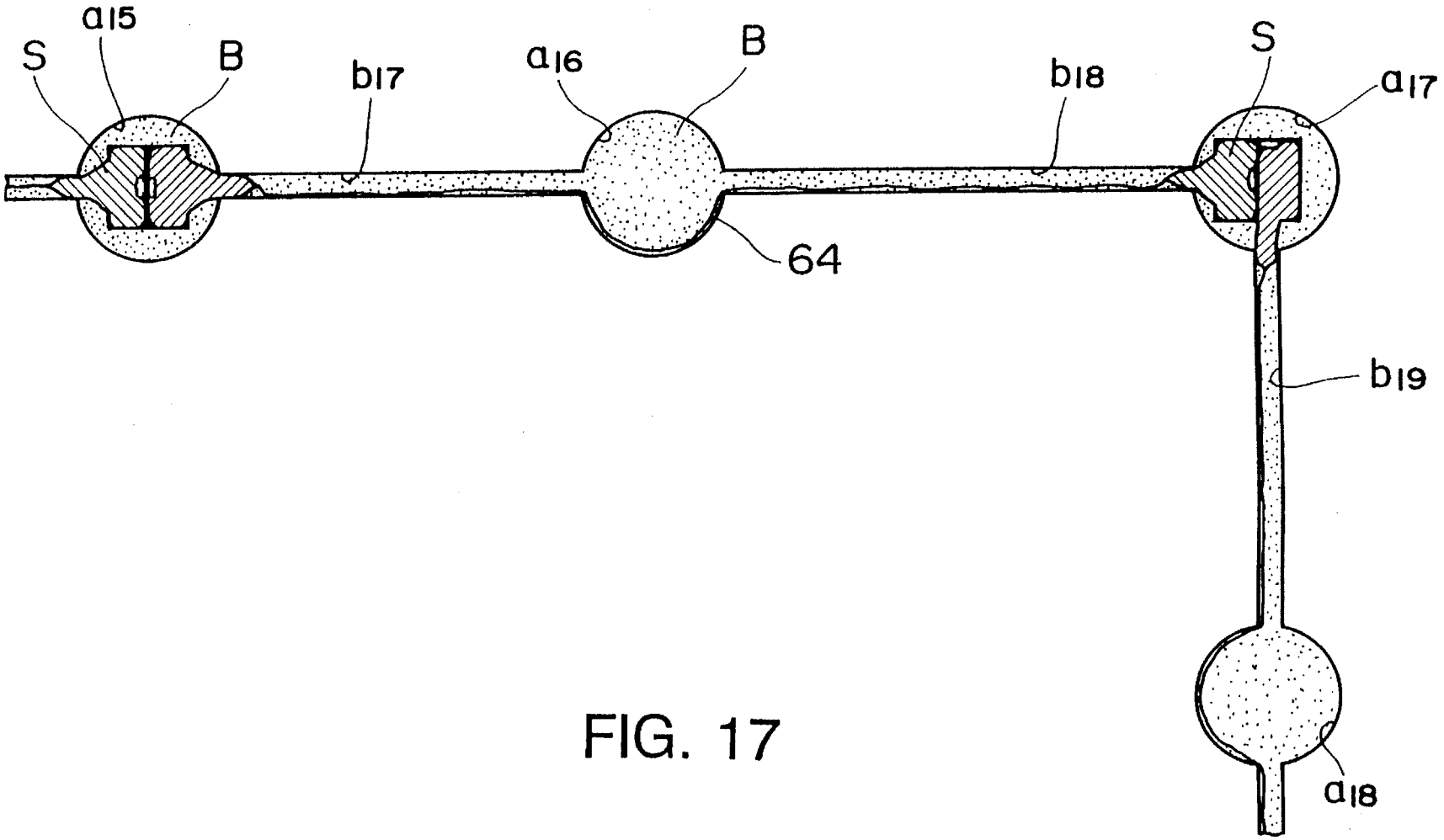
FIG. 17 is described as being a sectional view of the major portion of the underground wall constructed according to the method specified in the present invention.
Figure 18:
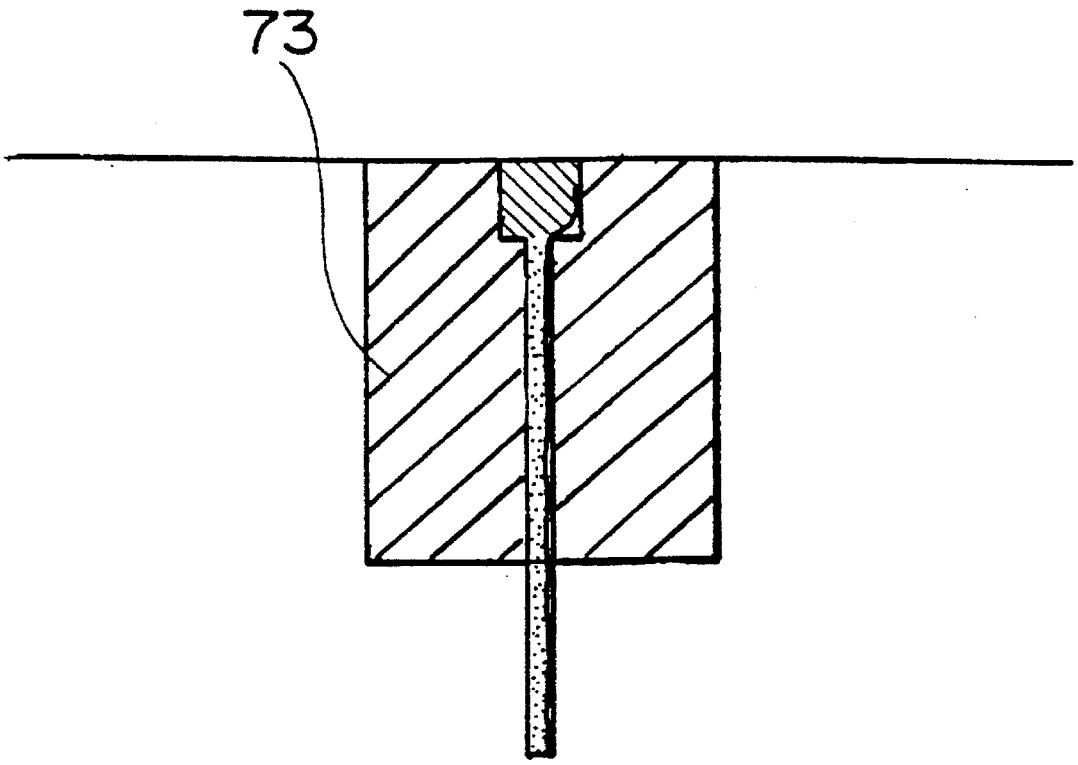
FIG. 18 is described as being a sectional view of the upper end of the underground wall constructed according to the method specified in the present invention.

After completing the injection of the cement paste S, the substitution of the bentonite-containing water A with the hardening muddy water B takes place in the dug-holes and ditches $a_n$, $b_n$ after or during the solidification of the cement paste S, as shown in FIG. 16. This is the second process. For this substitution, the bentonite-containing water A collected from the dug-holes and ditches $a_n$, $b_n$. At a mud making plant 71 the water A is added with a fixed amount of cement to prepare the hardening muddy water B. Then the hardening muddy water B is fed to the dug-holes and ditches $a_n$, $b_n$ by using a pump 72. When the hardening muddy water B is hardened, underground walls as shown in FIG. 17 are constructed, then followed by the formation of concrete walls 73 on the upper ends of the underground walls for the completion of whole construction (see FIG. 18).

According to the method for constructing underground walls employing the processes as described above, when the digging of holes while filling the bentonite-containing water A in the soil foundation is taken place, a plurality of the round holes $a_n$ are made in the soil foundation at fixed intervals and the plate digging bits 42, 44 makes reciprocating movements while receiving the percussion force when continuously making the ditch-like space $b_n$ of which thickness is less than the diameter of the round holes $a_n$ up to a fixed depth between the round holes $a_n$. Therefore, it is possible to shred stone pieces with the percussions force even in a soil foundation containing many stone pieces and to facilitate the efficient construction of the thin underground walls.

Further, according to the constitution of the present embodiment, the joint member 50, 50*a* is inserted into the round hole $a_n$, a sheet in bag form 64 with an open upper end is attached to the joint member 50, 50*a*, and the hardening muddy water B is filled into the dug-holes and ditches $a_n$, $b_n$ after blocking the connection between the round hole $a_n$ and the ditch-like space $b_n$ by filling cement paste S into the sheet 64 to thereby expanding the sheet, so that the capacity of the connecting parts of the underground walls for blocking water is secured.

Moreover, the existence of the sheet 64 in the connecting area whereto the cement paste S was filled, can improve the water blocking capacity at the area. Again, according to the constitution of the present embodiment, by using the bag part 64*a* in concave shape provided to the sheet 64, it is possible to form a structure wherein the cement paste S is solidified at the most bottom side of underground wall, which allows to efficiently reinforce the strength of the most bottom site of the underground wall which is likely to be weakened due to slime, etc.

Although the method using the hardening muddy water B as the hardening muddy substance to be filled into the dug-holes and ditches $a_n$, $b_n$ is exemplified in the embodiment described above, the present invention should not be limited to this use. It is possible to use concrete instead of the hardening muddy water B. Also, the hardening muddy substance to be filled into the dug-holes and ditches $a_n$, $b_n$ can be filled at once after all the dug-holes and ditches $a_n$, $b_n$ were made. However, it is naturally possible to fill the hardening muddy substance in unit by unit being divided into a certain length with the bag part 64*a* attached to the sheet 64.

Figure 19:
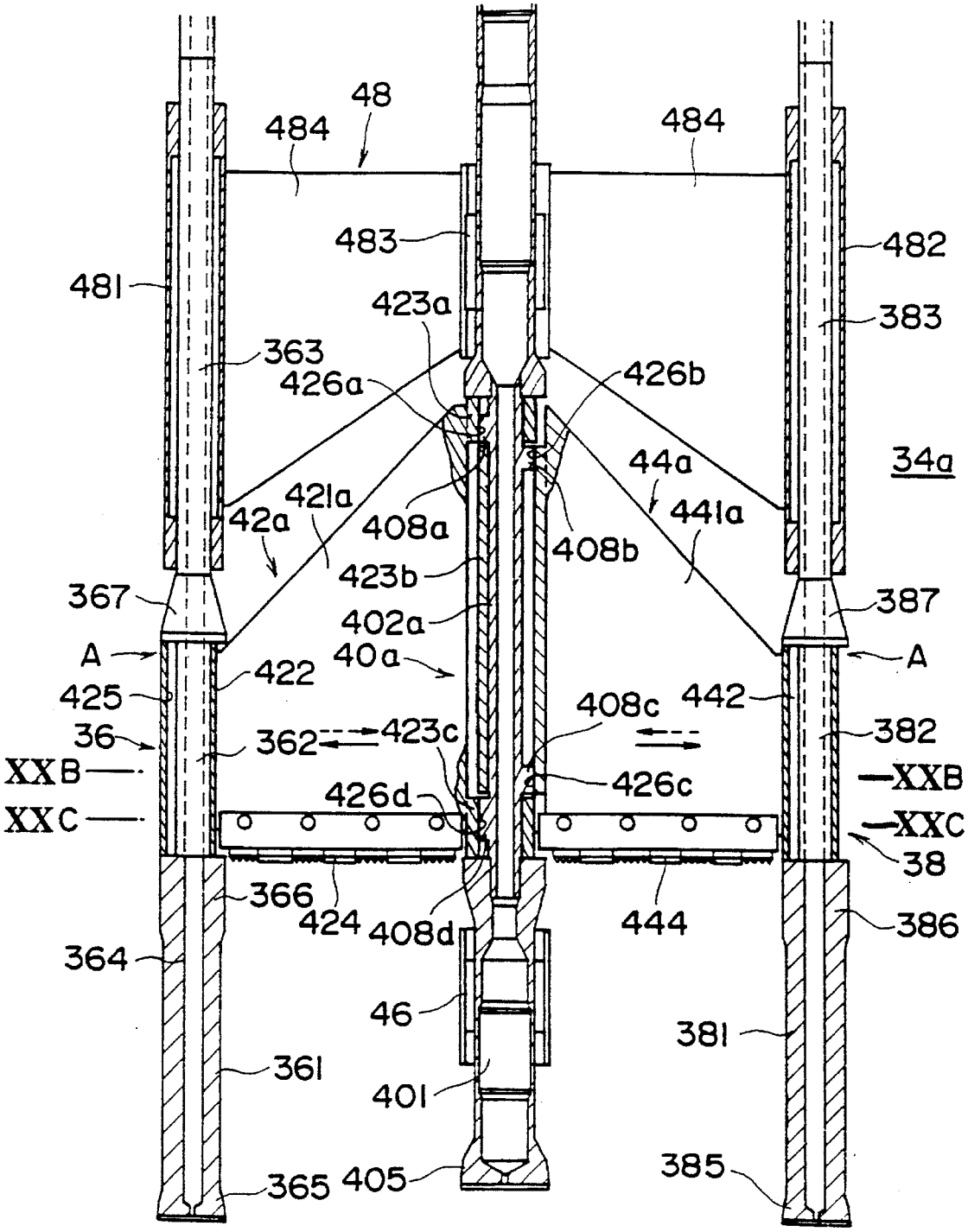
FIG. 19 is described as being a front view of the digging bits system for illustrating the second embodiment for the apparatus for digging soil foundation according to the present invention.
Figure 20A:
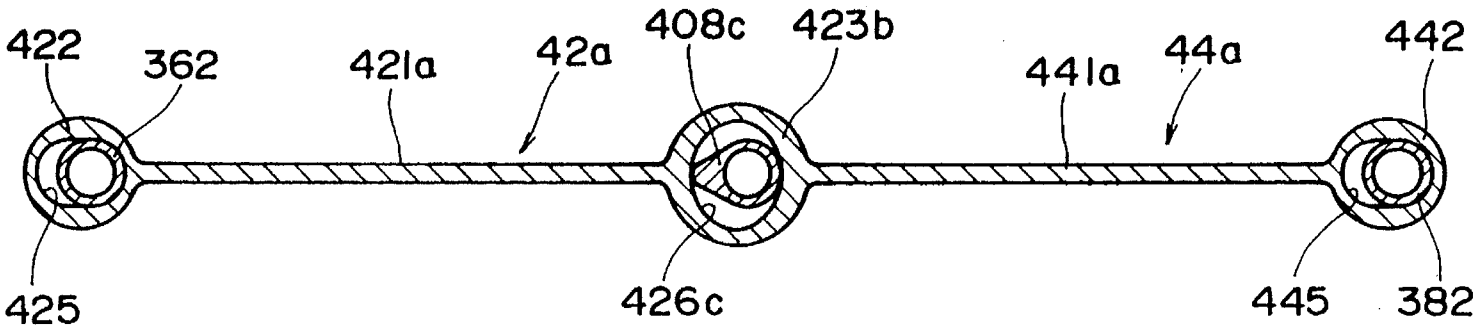
FIGS. 20A–B are described as being a sectional view for showing the section cut from XXB to XXB and the section cut from XXC to XXC in FIG. 19.
Figure 20B:
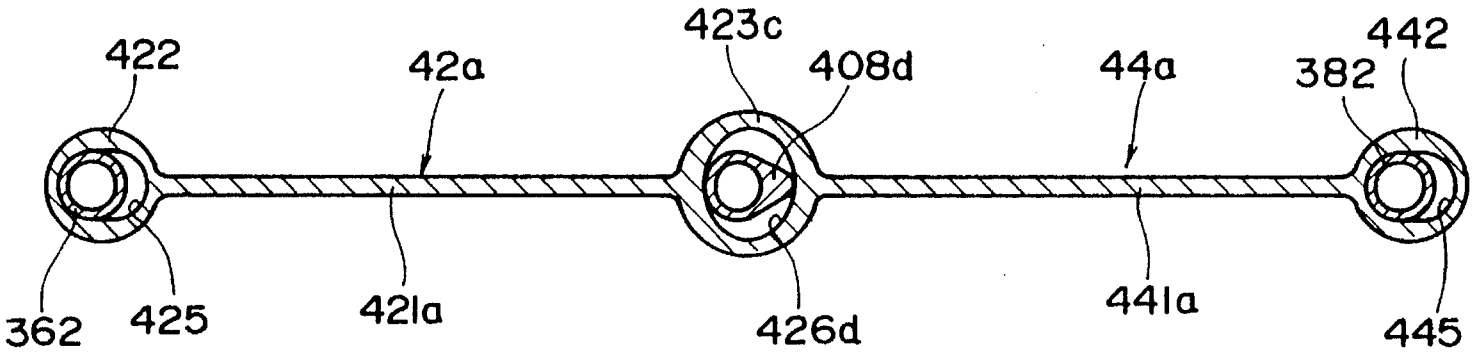
Figure 21:
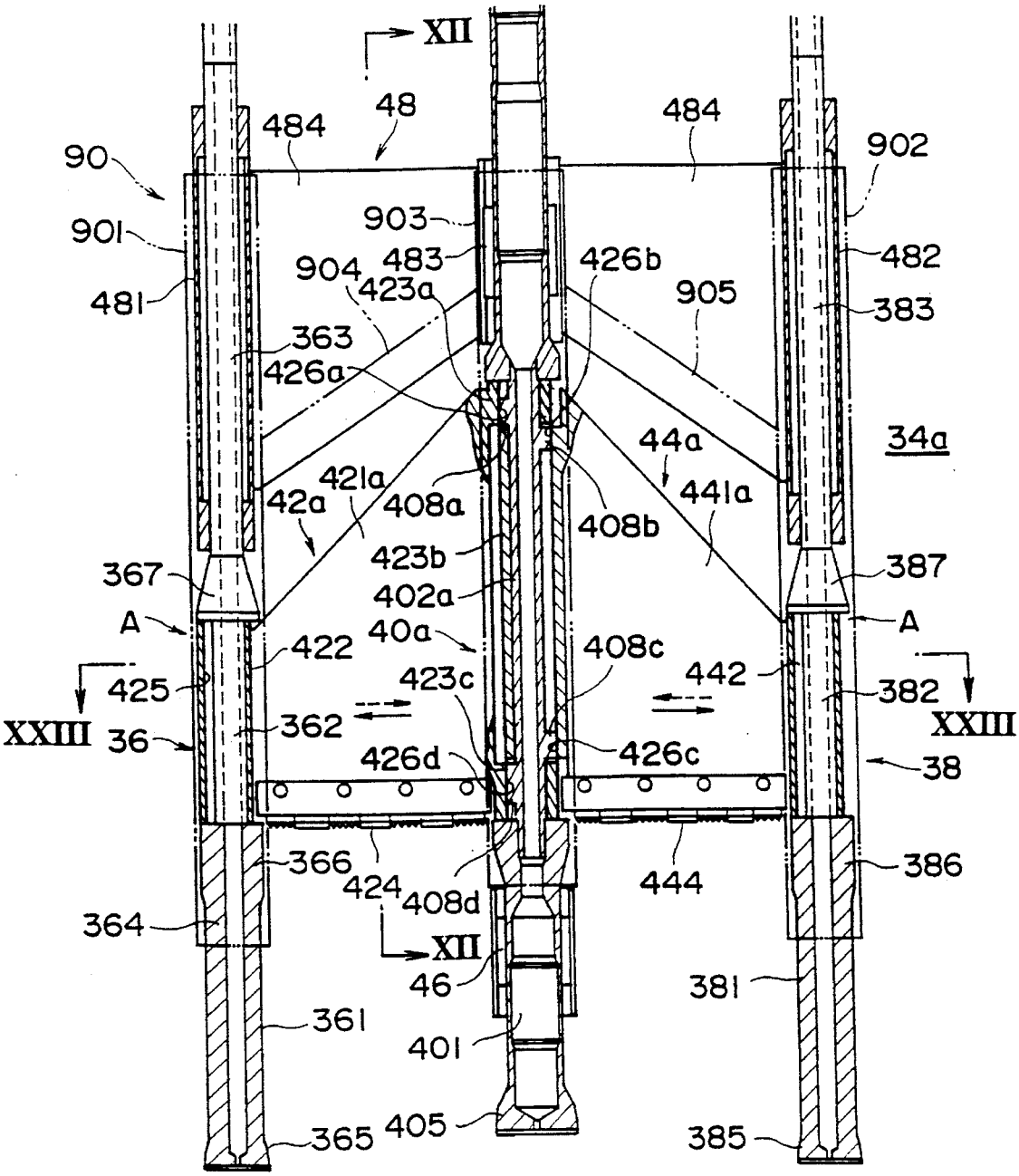
FIG. 21 is described as being a front view of the digging bits system for illustrating the third embodiment for the apparatus for digging soil foundation according to the present invention.
Figure 22:
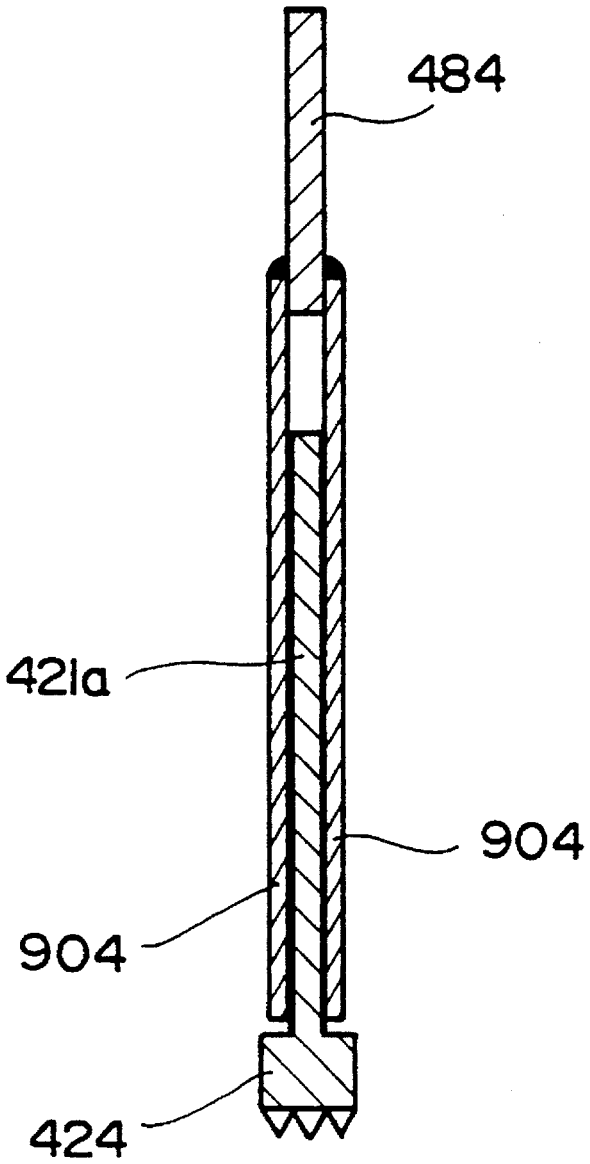
FIG. 22 is described as being a sectional view for showing the section cut from XXII to XXII in FIG. 21.
Figure 23:
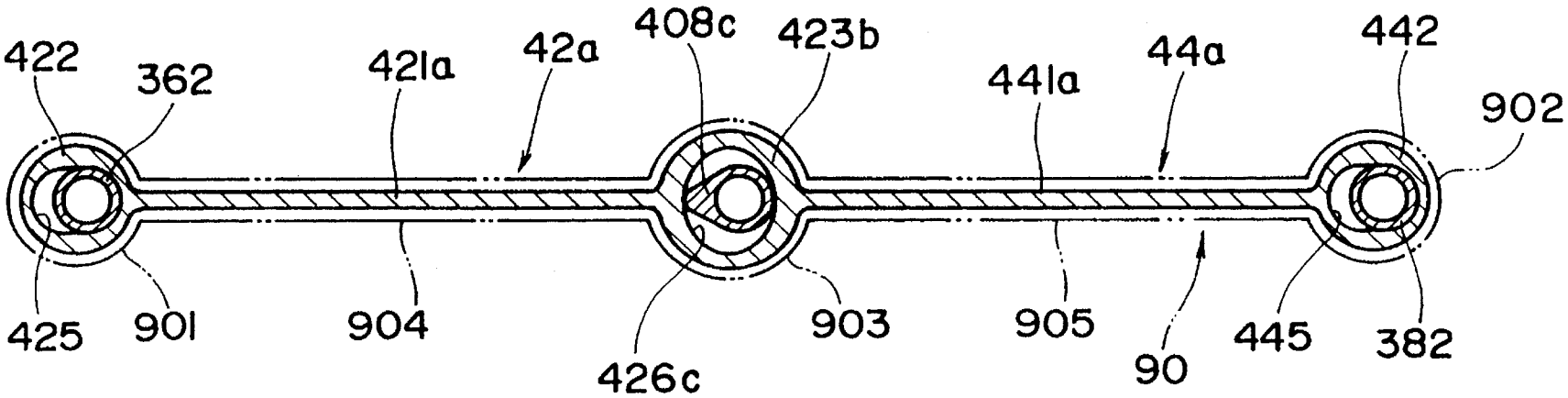
FIG. 23 is described as being a sectional view for showing the section cut from XXIII to XXIII in FIG. 21.

FIGS. 19 and 20 illustrate the second embodiment for the apparatus for digging soil foundation according to the present invention, and the characteristic features of the apparatus are described hereinbelow. In the digging bits systems 34*a* of the apparatus for digging soil foundation shown in the figures, the central sleeve 423 as described in the fist embodiment is divided into three parts which consisting of the first, second and third central sleeves 423*a* through 423*c*. And both on the upper end and the under end of the outer periphery of the middle tubular body 402*a* of the cylindrical central digging bit 40*a*, there are provided four pairs of cams, the first cam to the fourth cam 408*a* through 408*d*, respectively.

Of the three central sleeves 423*a* through 423*c*, two central sleeves 423*a*, 423*c* locating at the upper and under end, respectively are formed in relatively short length. Followers 426*a* through 426*d* contact the first to fourth cam 408*a* through 408*d*, respectively, are formed on the interior peripheral surface of the first to third central sleeves 423*a* through 423*c*, respectively. Each section of the followers 426*a* through 426*d* has the same views as the one of the follower 426 described in the first embodiment. Furthermore, among the first to fourth cams 408*a* through 408*d*, the pair consisting of the cams locating at the upper and under end sides is formed on the same phase and the pair consisting of the cams locating at the intermediate sides is formed on another same phase, respectively, and each phase for the both pairs differs by 180 degree with each other.

To each of the outer peripheral surface of the first and third central sleeve 423*a*, 423*c*, only the interior periphery side of the base plate 421*a* of the left plate digging bit 42*a* is fixed, while only the interior periphery side of the base plate 441*a* of the right plate digging bit 44*a* is fixed on the outer peripheral surface of the second central sleeve 423*b*. According to the digging apparatus of this embodiment constituted as described above, the right and left plate digging bits 42*a*, 44*a* take reciprocating moving in different directions with each other when the central cylindrical digging bit 40 is turned by the rotary driving device 30.

The apparatus of the second embodiment can provide the advantageous effect similar to the effect given by the apparatus of the first embodiment, and moreover, the apparatus of the second embodiment can increase the stability of the central cylindrical digging bit 40*a*, because the left and right plate digging bits 42*a*, 44*a* take reciprocating moving in different directions with each other to thereby mutually decrease the force applied to the central cylindrical digging bit 40*a*, which force is arisen in accompanying with the moving of the plate digging bits 42*a*, 44*a*.

In FIGS. from 21 to 23, there is shown the third embodiment of the apparatus for digging soil foundation according to the present invention, and the characteristic features thereof are described hereinbelow. The basic constitution of the third embodiment as the apparatus for digging soil foundation as shown in the figures is similar to the constitution of the second embodiment, however, there is provided the following characteristic in the constitution, that is, the installation of a casing 90 on the outer periphery of the digging bit system 34*a* of the third embodiment.

The casing 90 covers the left, right and central cylindrical digging bits 36, 38, 40*a* and also the left and right plate digging bits 42*a*, 44*a*, while leaving a fixed space from the outer periphery of the system 34*a*. The casing 90 includes a left and a right hollow tube 901, 902 for covering the outer periphery of the left and right cylindrical digging bits 36, 38, respectively, a central robe 903 for covering the outer periphery of the central cylindrical digging bit 40, and a left and a right plate 904, 905 in a pair being fixed in opposite between the robes 901 through 903 for covering the outer periphery of the left and right plate digging bits 42*a*, 44*a*, respectively.

The upper end side of the left and right plates 904, 905 is fixed to the under end side of the connecting plate 484 of the connecting member 48, respectively and the under end side of the left and the right plates 904, 905 is extending to the upper side of the bit piece 424, 444, respectively. The under end side of the central robe 903 is connected to the upper end of the stabilizer 46, and a slit (not shown) to which the bit edge 405 can be inserted is provided to the under end side of the stabilizer 46.

According to the apparatus for digging soil foundation constituted as described above, in addition to the advantageous effects similar to the effects obtained by the digging apparatuses of the first and second embodiments, the following advantageous effects can also be obtained particularly in a case that the soil foundation at the site of digging is in a rather soft condition. Namely, when the soil foundation at the site of digging is in a rather soft condition, the stabilizer 46 provided to the central cylindrical digging bit 40*a* encroaches on the wall of the dug-hole to thereby cause a problem in the stability of the central cylindrical digging bit 40*a*. However, if the casing 90 is provided as done in the third embodiment, the stability of the central cylindrical digging bit 40*a* is increased because the reacting force generated at converting the turning moving of the central cylindrical digging bit 40*a* to the reciprocating moving is secured by the casing 90.

In addition thereto, the casing 90 enters into the dug-space as the digging operation is proceeding, then attaches to the wall of the dug-space to thereby prevent the collapse of the wall.

Figure 24:
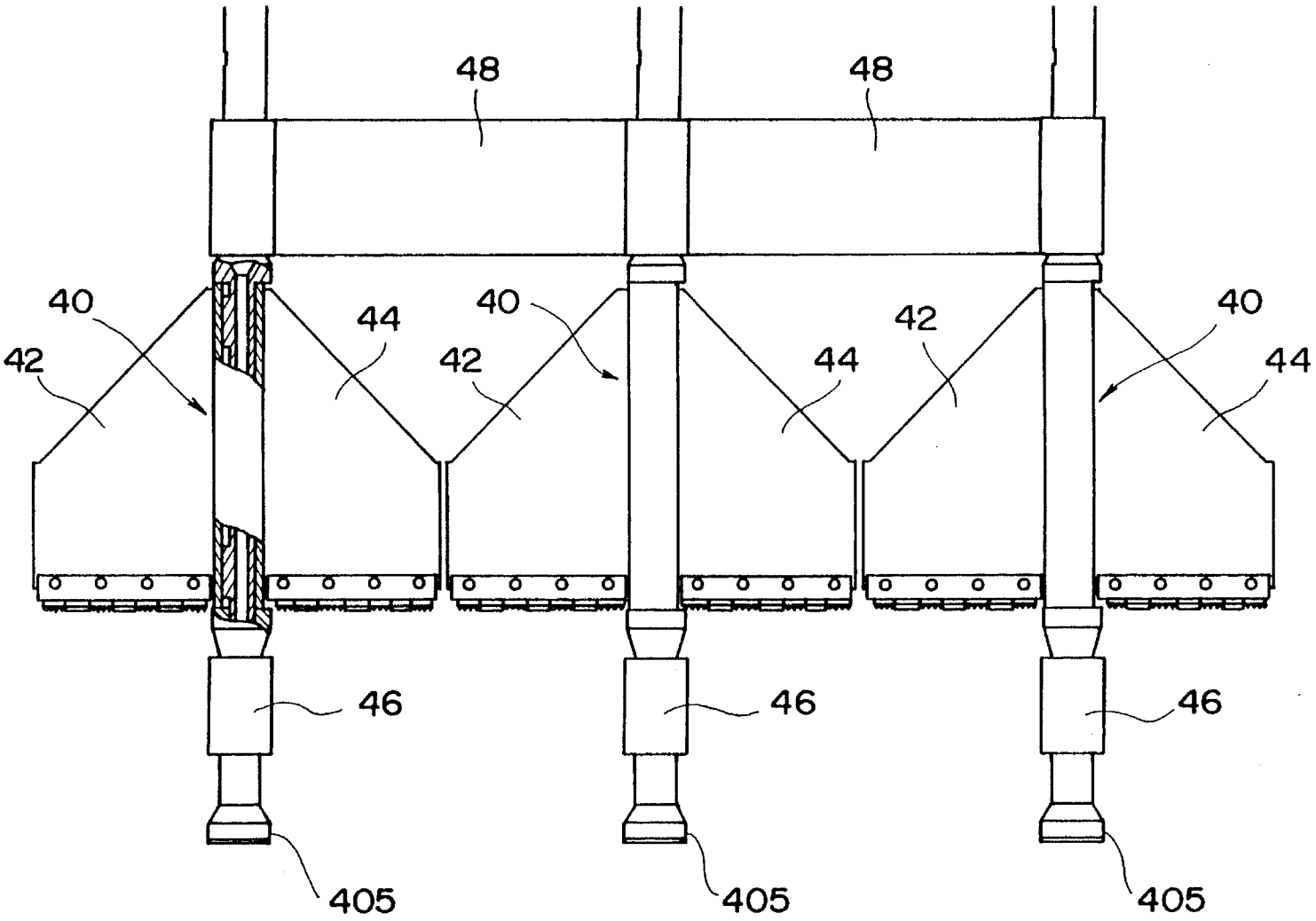
FIG. 24 is described as being a front view of the digging bits system for illustrating the fourth embodiment the apparatus for digging soil foundation according to the present invention.

FIG. 24 illustrates the fourth embodiment of the apparatus for digging soil foundation according to the present invention, and the characteristic features thereof are described hereinbelow. In the embodiment shown in FIG. 24, three cylindrical digging bits are all composed in substantially the same constitution as the one of the central cylindrical digging bit 40 of the first embodiment. In the fourth embodiment, the reciprocation moving of each plate digging bit 42, 44 in a synchronized condition is required. When the reciprocating moving under such condition has taken place, the advantageous effects obtained with the apparatus for digging soil foundation of the first embodiment can also be obtained by the digging apparatus of the fourth embodiment, and particularly, the formation of the dug-space can be further facilitated with high efficiency when the digging apparatus of the fourth embodiment is employed.

Figure 25:
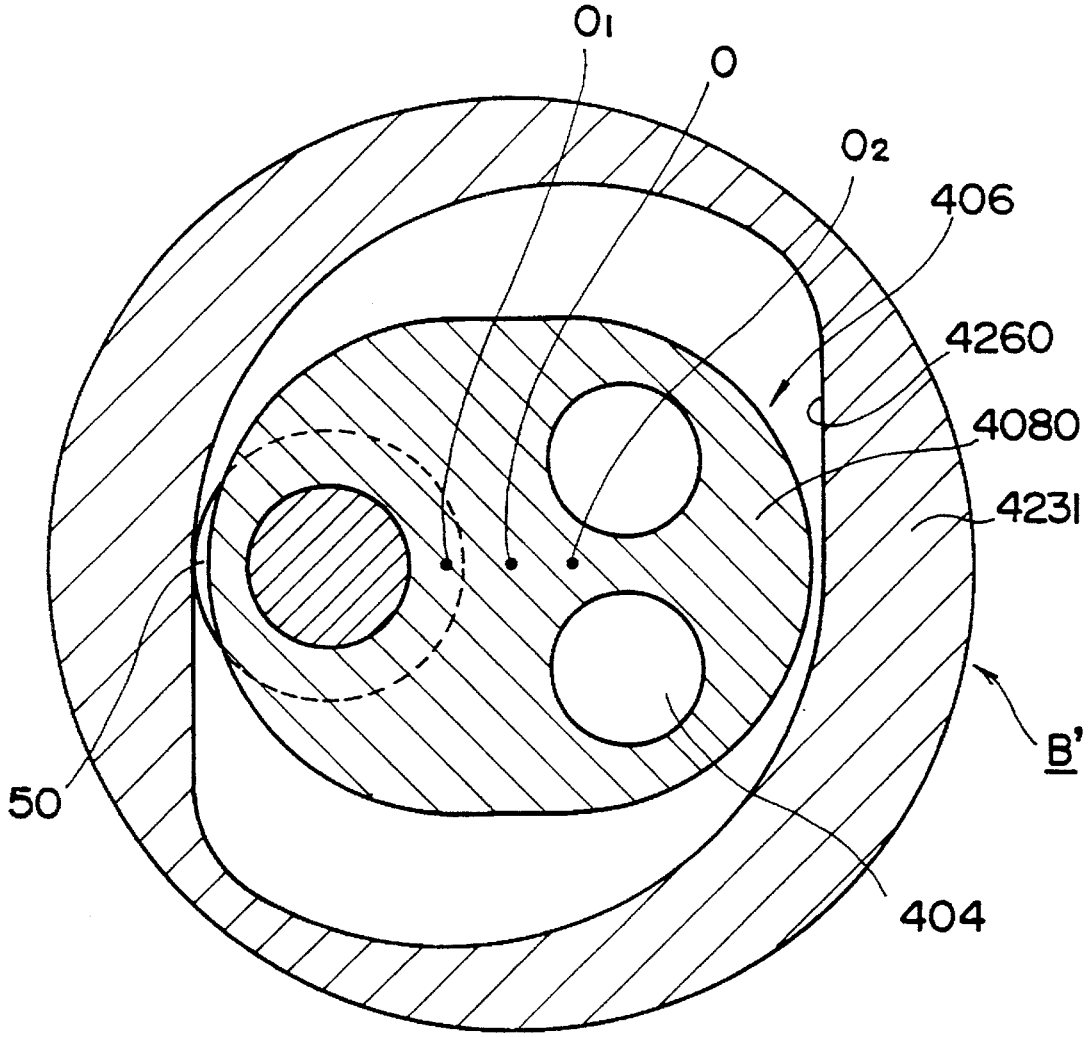
FIG. 25 is described as being a sectional view of the moving direction converter for illustrating the fifth embodiment for the apparatus for digging soil foundation according to the present invention.

FIG. 25 illustrates the fifth embodiment for the apparatus for digging soil foundation according to the present invention, and the characteristic features thereof are described hereinbelow. The embodiment shown in the figure is the modification of the moving direction converter B' for converting the turning force, which is applied from the rotary driving device 30 to the central cylindrical digging bit 40, to the reciprocating moving to thereby transfer the force to the left and right plate digging bits 42, 44. The moving direction converter B' shown in the figure uses a cam 4080 provided to the outer periphery of the middle tubular body 402 of the central cylindrical digging bit 40*b* and a follower 4260 provided respectively to the interior peripheral surface of the central sleeve 4231 placed in the center of the plate digging bit 42, 44, and the cam 4080 is formed in shape of which sectional view being elliptic.

The follower 4260 has an interior peripheral surface which draws two arcs in same size respectively from the two points 01, 02 located opposite at both sides of the central axis 0 of the cam 4080 at the same interval and two tangent lines connecting the two arcs, respectively, and the short axis of the follower 4260 is provided toward a direction corresponding to the longitudinal direction of the bit piece 424, 444, while the long axis thereof is provided toward a direction which inclines by approximately 45 degree from the thickness direction of the bit piece 424, 444.

On the long axis of the cam 4080, a roller 50 for rotatably moving in contacting with the follower 4080 is provided. By using the apparatus for digging soil foundation using the moving direction converter B' constituted as described above, the advantageous effects same as those obtained in the embodiments described above can be obtained. Although the apparatus for digging soil foundation using three cylindrical digging bits 36, 38, 40 are exemplified in the embodiments described above, the present invention should not be limited to the digging apparatus described in those embodiments, and therefore the other constitution such as the one using two cylindrical digging bits and providing a plate digging bit between the cylindrical digging bits, or the one using four or more of cylindrical digging bits, can also be employed.

According to the apparatus for digging soil foundation and the method for constructing underground walls using the apparatus specified in the present invention, the formation of thin dug-space can be achieved efficiently, and the underground walls to be used as soft-blocking walls required to have water-blocking capacity can be constructed economically by utilizing these thin dug-space.

What is claimed is:

1. A digging apparatus comprising:

a cylindrical digging bit;

a plate digging bit extending radially outward from said cylindrical digging bit;

a rotary driving means for rotating said cylindrical digging bit;

a percussion means for applying percussion force to said cylindrical digging bit;

movement converting means positioned between said cylindrical digging bit and said plate digging bit and for converting rotary movement of said cylindrical digging bit into reciprocating movement of said plate digging bit;

percussion transfer means positioned between said cylindrical digging bit and said plate digging bit and for transferring said percussion force from said cylindrical digging bit to said plate digging bit.

2. An apparatus in accordance with claim 1, wherein:

said plate digging bit has a thickness less than a diameter of said cylindrical digging bit.

3. An apparatus in accordance with claim 1, further comprising:

a plurality of said cylindrical digging bits, each of said plurality of cylindrical digging bits defining a pore for supply muddy water;

a plurality of plate digging bits extending radially from each of said cylindrical bits.

4. An apparatus in accordance with claim 1, further comprising:

a plurality of said cylindrical digging bits, said plurality of cylindrical digging bits being substantially positioned in plane;

connecting means positioned between said plurality of cylindrical digging bits and for connecting said plurality of cylindrical digging bits together.

5. An apparatus in accordance with claim 1, wherein:

said cylindrical digging bit is a central bit and first and second cylindrical digging bits are spaced from said central bit;

said plate digging bit includes a first plate positioned between said central bit and said first cylindrical digging bit, said plate digging bit includes a second plate positioned between said central bit and said second cylindrical digging bit;

said movement converting means moving said first and second plates in substantially a same direction at substantially a same time.

6. An apparatus in accordance with claim 1, wherein:

said cylindrical digging bit is a central bit and first and second cylindrical digging bits are spaced from said central bit;

said plate digging bit includes a first plate positioned between said central bit and said first cylindrical digging bit, said plate digging bit includes a second plate positioned between said central bit and said second cylindrical digging bit;

said movement converting means moving said first and second plates in different directions.

7. An apparatus in accordance with claim 1, wherein:

said cylindrical digging bit is a central bit and first and second cylindrical digging bits are spaced from said central bit;

said plate digging bit includes a first plate positioned between said central bit and said first cylindrical digging bit, said plate digging bit includes a second plate positioned between said central bit and said second cylindrical digging bit;

said movement converting means is connected to said central bit and said first and second cylindrical digging bits.

8. An apparatus in accordance with claim 1, wherein:

said movement converting means includes a cam on said cylindrical digging bit and a tube on said plate digging bit, an interior of said tube having a surface cooperating with said cam.

9. An apparatus in accordance with claim 1, wherein:

said plate digging bit includes a plurality of bit pieces, each of said plurality of bit pieces having a length substantially equal to a length of said reciprocating movement, each of said plurality of bit pieces including convex parts, said convex parts of adjacent bit pieces being positioned to substantially intersect.

10. A method for constructing underground walls, the method comprising the steps of:

forming a plurality of substantially round holes at substantially fixed intervals in a soil foundation;

providing a plate digging bit between said substantially round holes;

reciprocating said plate digging bit between said substantially round holes to form ditch-like spaces between said substantially round holes, said ditch-like spaces having a thickness less than a diameter of said substantially round holes;

filling said substantially round holes and said ditch-like spaces with a hardening muddy substance.

11. A method in accordance with claim 10, further comprising:

inserting joint members into said round holes;

placing a bag-shaped sheet with an opened end into said ditch-like spaces and between said joint members;

filling said sheet with said hardening muddy substance to extend said sheet and block a connection between said round hole and said ditch-like space before said filling of said round holes and said ditch-like space.

12. A method in accordance with claim 11, wherein:

said bag-shaped sheet forming a bag on lateral and bottom edges of said sheet.

* * * * *